US007587825B2

(12) United States Patent
Coleman et al.

(10) Patent No.: US 7,587,825 B2
(45) **Date of Patent: *Sep. 15, 2009**

(54) METHOD FOR PRODUCING A WHEEL DISC

(75) Inventors: Alan Coleman, Southgate, MI (US); Tom Czarniecki, Dearborn, MI (US); Bill Fowler, Sedalia, MO (US)

(73) Assignee: Hayes Lemmerz International, Inc., Northville, MI (US)

( * ) Notice: Subject to any disclaimer, the term of this patent is extended or adjusted under 35 U.S.C. 154(b) by 564 days.

This patent is subject to a terminal disclaimer.

(21) Appl. No.: 11/344,621

(22) Filed: Feb. 1, 2006

(65) Prior Publication Data

US 2007/0175037 A1 Aug. 2, 2007

(51) Int. Cl.

| | |
|---|---|
| ***B21D 53/26*** | (2006.01) |
| ***B21D 22/00*** | (2006.01) |
| ***B23D 17/00*** | (2006.01) |
| ***B21K 1/38*** | (2006.01) |
| ***B21J 5/00*** | (2006.01) |
| ***B60B 3/10*** | (2006.01) |

(52) U.S. Cl. ..... 29/894.3; 29/894.323; 29/894.324; 29/894.325; 29/894.33; 29/894.353; 72/353.2; 72/353.6; 72/354.2; 301/64.101; 301/64.102

(58) Field of Classification Search ..... 29/894, 29/894.3, 894.323–325, 894.33, 894.353; 72/353.2, 353.6, 354.2; 301/101, 102
See application file for complete search history.

(56) References Cited

U.S. PATENT DOCUMENTS 1,061,284 A * 5/1913 Hansen ..... 29/894.01
1,376,390 A 4/1921 Michelia
1,544,242 A 6/1925 Lavery
1,743,944 A 1/1930 Watrous (Continued)

FOREIGN PATENT DOCUMENTS

DE 1 605 544 3/1971

(Continued)

OTHER PUBLICATIONS

1998 Full Face Vehicle Wheel.

(Continued)

*Primary Examiner*—David P Bryant
*Assistant Examiner*—Alexander P Taousakis
(74) *Attorney, Agent, or Firm*—MacMillan, Sobanski & Todd, LLC

(57) ABSTRACT

A method of forming a wheel disc starts with a flat blank. A plurality of windows are formed in the wheel disc, wherein each window has a respective outer edge proximate with a continuous outer band around a periphery of the wheel disc. The windows define a plurality of spokes between adjacent windows, and the angular size of each of the windows along the outer band is preferably greater than the angular size of each of the spokes. The outer band is partially closed toward a cylindrical shape by engaging a cam die against at least a portion of the outer band. The outer band is substantially fully closed into a cylindrical shape by axially wiping the outer band using a cylindrical die. The intermediate camming operation achieves the desired final shape after wiping without introducing stresses that would weaken or distort the wheel disc.

24 Claims, 27 Drawing Sheets

U.S. PATENT DOCUMENTS

| | | | | |
|---|---|---|---|---|
| 1,750,483 | A | 3/1930 | Michelin | |
| 1,890,546 | A | 12/1932 | Michelin | |
| 1,897,375 | A | 2/1933 | Greenwald | |
| 2,143,457 | A | 1/1939 | Sinclair | |
| 2,162,751 | A | 6/1939 | Sauzedde | |
| 2,187,032 | A | 1/1940 | Horn et al. | |
| 2,406,062 | A | 8/1946 | Cornell | |
| 2,481,187 | A | 9/1949 | Ash | |
| 3,623,774 | A | 11/1971 | Funke et al. | |
| 3,989,307 | A | 11/1976 | Reppert | |
| 4,074,559 | A * | 2/1978 | Beane et al. | 72/354.2 |
| 4,124,051 | A | 11/1978 | Horton | |
| 4,181,365 | A | 1/1980 | Kawaguchi et al. | |
| 4,256,346 | A | 3/1981 | Kawaguchi et al. | |
| 4,897,909 | A | 2/1990 | LaVoy | |
| 5,188,429 | A | 2/1993 | Heck et al. | |
| 5,360,261 | A | 11/1994 | Archibald et al. | |
| 5,452,599 | A | 9/1995 | Daudi et al. | |
| 5,533,261 | A | 7/1996 | Kemmerer | |
| 5,544,945 | A | 8/1996 | Daudi | |
| 5,568,745 | A | 10/1996 | Daudi | |
| 5,899,537 | A | 5/1999 | Abe et al. | |
| 5,899,538 | A | 5/1999 | Tatraux-Paro et al. | |
| 6,042,194 | A | 3/2000 | Fitz et al. | |
| 6,244,669 | B1 | 6/2001 | Braunschweiler | |
| 6,282,788 | B1 * | 9/2001 | Politi et al. | 29/894.323 |
| 6,546,629 | B2 * | 4/2003 | Politi | 29/894.322 |
| 6,779,852 | B2 | 8/2004 | Van Houten et al. | |
| 6,785,962 | B2 | 9/2004 | Coleman | |
| 2003/0178887 | A1 | 9/2003 | de A. Sereno | |
| 2004/0227392 | A1 | 11/2004 | Coleman et al. | |
| 2008/0034587 | A1 | 2/2008 | McCorry et al. | |

FOREIGN PATENT DOCUMENTS

| | | |
|---|---|---|
| DE | 26 39 483 | 3/1978 |
| EP | 1 262 333 B1 | 12/2002 |
| FR | 891.283 | 3/1944 |
| JP | 56-43001 A | 4/1981 |
| JP | 57-70089 | 4/1982 |
| JP | 60-124501 | 7/1985 |
| JP | 62-34801 | 2/1987 |

OTHER PUBLICATIONS

1988 Bead-Seat Attached Vehicle Wheel.
1994 Well-Attached Vehicle Wheel Photo #1.
1994 Well-Attached Vehicle Wheel Photo #2.
1986 Well-Attached Vehicle Wheel.
Motor Wheel Corporation Drawing L-36273, Feb. 24, 1967, Wheel Assem.~14X6JK~5" B.C.~5-Holes.
Motor Wheel Corporation Ddrawing L-36274, Feb. 24, 1967, Disc~14" Dia. 5" B.C.~5-Holes.
US 6,755,485, 06/2004, Chase (withdrawn)

* cited by examiner

METHOD FOR PRODUCING A WHEEL DISC

CROSS REFERENCE TO RELATED APPLICATIONS

The present application is related to co-pending U.S. application Ser. No. 10/836,828 and co-pending U.S. application Ser. No. 11/345,530.

BACKGROUND OF THE INVENTION

The present invention relates to vehicle wheels and, more specifically, to an improved method for producing a wheel disc adapted for use in such a vehicle wheel.

One type of conventional fabricated vehicle wheel comprises a two-piece construction having an inner disc and an outer rim. The disc includes an inner wheel mounting portion and an outer annular portion. The wheel mounting portion defines an inboard mounting surface and includes a center pilot or hub hole, and a plurality of lug receiving holes formed therethrough for mounting the wheel to an axle of the vehicle. The rim is fabricated from steel, aluminum, or other alloys, and includes an inboard tire bead seat retaining flange, an inboard tire bead seat, an axially extending well, an outboard tire bead seat, and an outboard tire bead seat retaining flange. The outer annular portion of the disc is typically secured to the inner radial surface of the rim by welding.

Some preferred materials for the disc are steel and other alloys which can be cold worked from a flat blank into the desired final shape of the disc. Using several stages of die stamping and punching, a wheel disc of sufficient dimensional accuracy and strength can be economically produced. An example of progressive die stamping to manufacture wheels discs with multi-stage, high speed transfer press equipment is shown in U.S. Pat. No. 5,568,745, issued to Daudi on Oct. 29, 1996, which is incorporated herein by reference in entirety.

In addition to stringent requirements for strength and shape of both the wheel disc and rim, an attractive styling of the wheel disc is desired. Windows are formed in a typical wheel disc in order to give the wheel a spoked appearance by forming a single spoke between each pair of adjacent windows. The windows also function to provide a flow of cooling air to brake units installed inboard of the wheel.

To further improve styling of a stamped wheel disc, cladding of various shapes and finishes may be applied to the outboard side of the wheel disc after it is assembled to the rim. The cladding shape may conform to the shape of the wheel disc or it may provide a very different appearance. Regardless of actual styling, it is preferable that enough "see-through" area remains after installing the cladding to allow sufficient air flow to cool the wheel and brake.

Recent trends in wheel styling have made it desirable to provide large windows so that the unitary spokes between windows are as small as possible. When a cladding is used, a large window size in the wheel disc provides greater flexibility in styling the cladding such that the cladding windows can be located in more arbitrary locations.

Using conventional techniques for fabricating stamped wheel discs from flat blanks, it has not been possible to obtain larger window sizes. During manufacture, the blank is typically bent over to form the outer band prior to punching the windows because if the windows were to be punched first then they would distort to an unacceptable degree during bending. With larger window sizes, a punching operation becomes increasingly difficult because of the need to provide the space to receive the slugs as they are punched out.

In order to obtain larger window sizes, other forming processes such as casting of aluminum have been employed. However, these other processes and materials are less well suited to low cost, mass production. Therefore, it would be desirable to obtain increase window sizes with a stamped wheel disc.

Co-pending U.S. application Serial No. 11/345,530 filed concurrently herewith, entitled "Disc Forming Process for Wheels with Large Windows," teaches an improved disc forming process that enables increased window size while maintaining disc strength and avoiding distortions even though the outer band is bent over after punching the larger windows. An intermediate camming operation performs a preliminary shaping prior to final shaping with a wipe die so that the disc may be formed without introducing stresses that would weaken the disc or distorting the window shape.

A potential problem associated with both the preliminary and final shaping of the outer band is unintended undulations. Due to the presence of the large windows, cyclic variations in the radial length of the outer band may be produced. The unintended length variations can produce undulations in the final outer band that run in a direction parallel with the wheel axis and/or perpendicular to the wheel axis. When the formed wheel disc is placed within the rim for welding, any undulations parallel to the wheel axis cause the seam for welding to be wavy, making it more difficult to perform the welding operation. Undulations perpendicular to the wheel axis result in discontinuous contact between the wheel disc and rim along the seam, preventing the formation of a strong welding joint. Therefore, it would be desirable to reduce undulations.

Die stamping operations to form a wheel disc are typically performed using a series of press stations with partially finished pieces being transferred between stations. In addition to the multiple stations, each station can be set up to perform more than one compatible metal forming operation such as bending some sections of the piece while a hole in another area of the piece is pierced. In order to produce a part most economically using the least equipment and factory floor space, it is desirable to use a fabrication process needing a minimal number of stations. Manufacturing costs are also dependent upon the complexity of the forming operations performed by each set of dies, both in terms of original cost of the tooling and maintenance during the useful lifetime of the tooling. Thus, it is further desirable to find a sequence of operations to form a desired wheel disc using less complicated steps without increasing the number of stations required.

SUMMARY OF THE INVENTION

The present invention provides an improved wheel disc forming process that enables an increased window size. The process reduces undulations while avoiding complex piercing operations and reducing the number of press stations.

In one aspect of the invention, a method is provided for forming a wheel disc. A flat disc blank is formed into a bowl shaped wheel disc. The bowl shaped wheel disc is formed to form spoke-forming regions adjacent window-forming regions. A window is formed in each of the window-forming regions in a substantially vertical direction, wherein each window has a respective outer edge proximate with a continuous outer band around a periphery of the wheel disc. The windows define a plurality of spokes between adjacent windows. An angular size of each of the windows along the outer band is preferably greater than an angular size of each of the spokes. The outer band is partially closed toward a cylindrical shape by engaging a cam die against at least a portion of the outer band, wherein the cam die comprises an engagement surface having an intermediate ledge for receiving a peripheral edge of the outer band to reduce undulations of the outer band. The outer band is fully closed substantially into a cylindrical shape by axially wiping the outer band.

Other advantages of this invention will become apparent to those skilled in the art from the following detailed description of the invention, when read in light of the accompanying drawings.

DETAILED DESCRIPTION OF THE INVENTION

Figure 2:
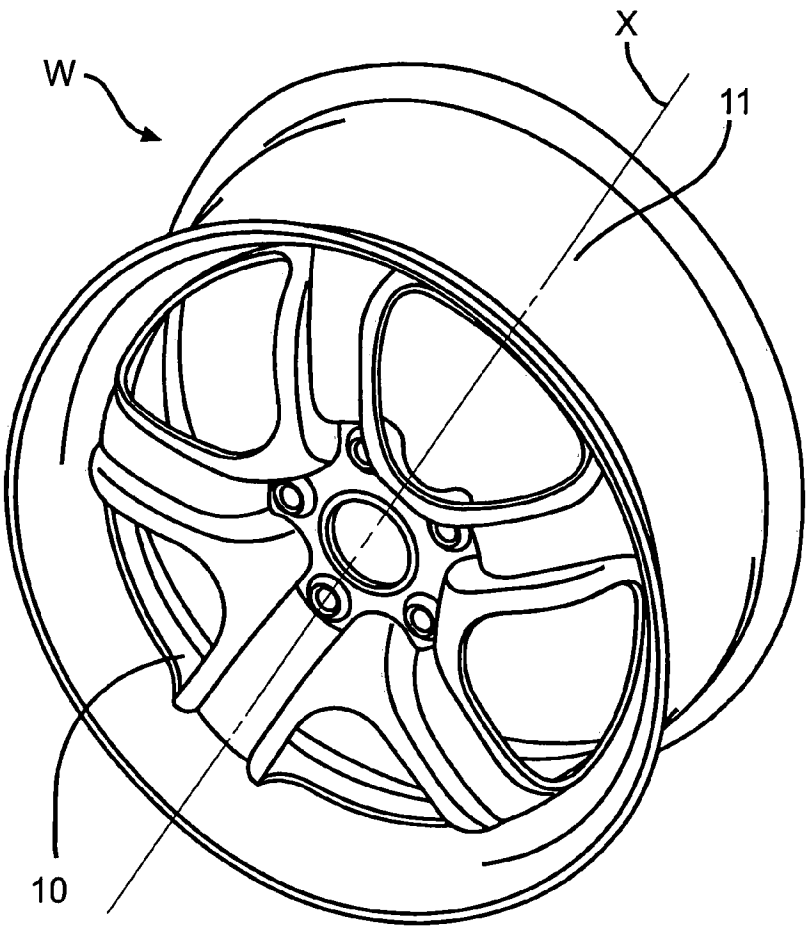
FIG. 2 is a perspective view of the wheel disc of FIG. 1 joined with a wheel rim.
Figure 1:
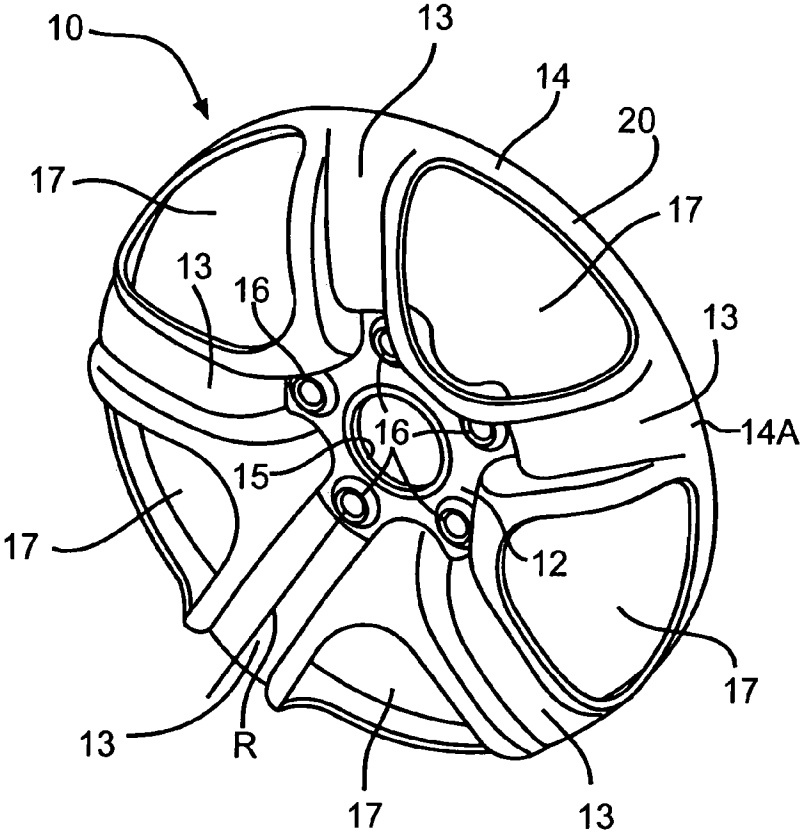
FIG. 1 is a perspective view of a wheel disc fabricated according to an embodiment of the present invention.

Referring to FIG. 1, a wheel disc 10 having the shape shown is to be made from flat stock using cold stamping. After it is made, disc 10 may be welded, riveted or otherwise suitably secured to a suitable rim 11, such as shown in FIG. 2, to produce a wheel W having a wheel or wheel disc axis X. Wheel rim 11 is fabricated from a suitable material, such as for example, steel, aluminum or alloys thereof, magnesium, or titanium.

Wheel disc 10 is fabricated or otherwise formed from a suitable material having the ductility necessary for cold working, such as for example, steel, aluminum or alloys thereof, steel, magnesium, or titanium. Wheel disc 10 includes a generally centrally located wheel mounting surface or contour 12, a plurality of outwardly extending unitary spokes 13, and an outer annular rim connecting band or flange 14. In the illustrated embodiment, disc 10 includes five of such unitary spokes 13 which are integral with the wheel mounting surface 12 and outer band 14. In the illustrated embodiment, the spokes are formed as solid spokes; however, one or more of the spokes 13 can have an opening(s) (not shown) formed therein if so desired. Also, as shown in the embodiment illustrated in FIG. 1, each spoke 13 defines a radial line R intersecting the wheel disc axis X and each spoke 13 is preferably symmetrical with respect to the radial line R. Alternatively, a different number, orientation and/or shape of spokes 13 can be employed if so desired.

Wheel mounting surface 12 is provided with a centrally located pilot aperture 15 and a plurality of lug bolt receiving holes 16 circumferentially spaced around pilot aperture 15. Lug bolt receiving holes 16 receive lug bolts (not shown) for securing the finished wheel on an axle of a vehicle.

Wheel disc 10 also includes a plurality of openings or windows 17 formed between adjacent spokes 13. As shown in the embodiment illustrated in FIGS. 1 and 2, the angular extent of windows 17 is preferably greater than the angular extent of unitary spokes 13, in particular at the outer radial periphery of disc 10 proximate to outer band 14. Alternatively, the angular extent of the windows 17 relative to the spokes 13 can be other than illustrated if so desired.

Outer band 14 extends in a generally axial direction and is joined to the remainder of disc 10 only by spokes 13. Consequently, the transitions between each spoke 13 and outer band 14 should be formed without fractures, cracks, or other imperfections that could weaken the structural integrity of the disc 10 and therefore the wheel. Since outer band 14 defines an annular mounting flange for welding to rim 11, it is bent down by approximately ninety degrees from the plane of the original blank during the stamping process. As shown in the embodiment illustrated in FIGS. 1 and 2, windows 17 are so large that a side edge surface 20 of windows 17 has its face generally perpendicular to the wheel axis X. In other words, outer band 14 is a generally flat cylinder with substantially no curvature (at least in the area of the circumferential center of each window 17) so as to extend in a generally axial direction and define a side edge surface 14A extending between each pair of adjacent spokes 13 which extends in a generally axial outboard direction. This generally flat cylindrical shape gives the least amount of intrusion of outer band 14 into the view through windows 17 after disc 10 is joined to rim 11 which is desirable for styling purposes. However, the degree of bending and the narrowness of unitary spokes 13 would result in excessive material stress at the transition between spokes 13 and outer band 14 when using prior art stamping processes.

Figure 3:
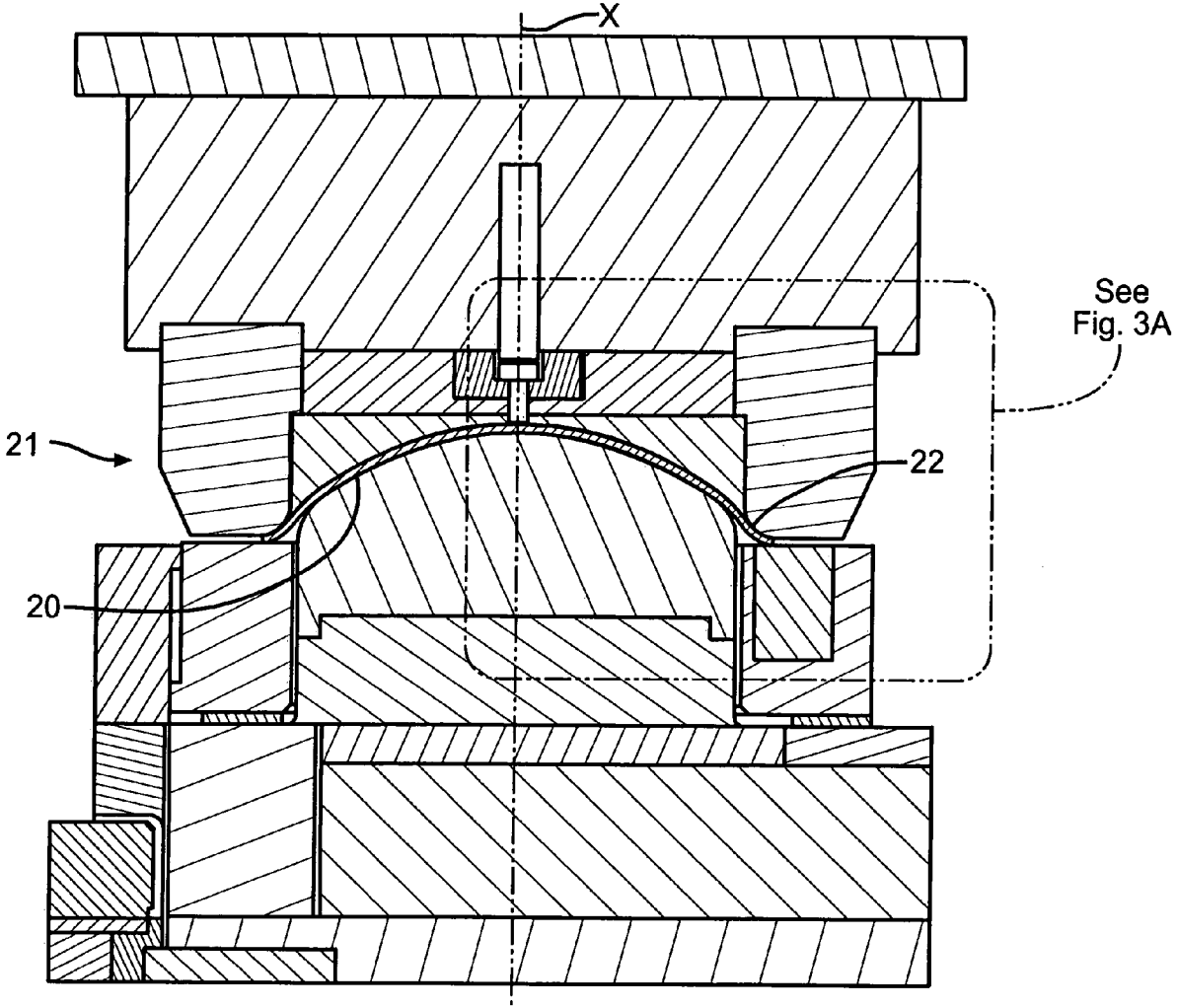
FIGS. 3 and 3A are cross-sectional views of a closed press after processing a wheel disc according to a first operation of a first embodiment of the present invention.
Figure 3A:
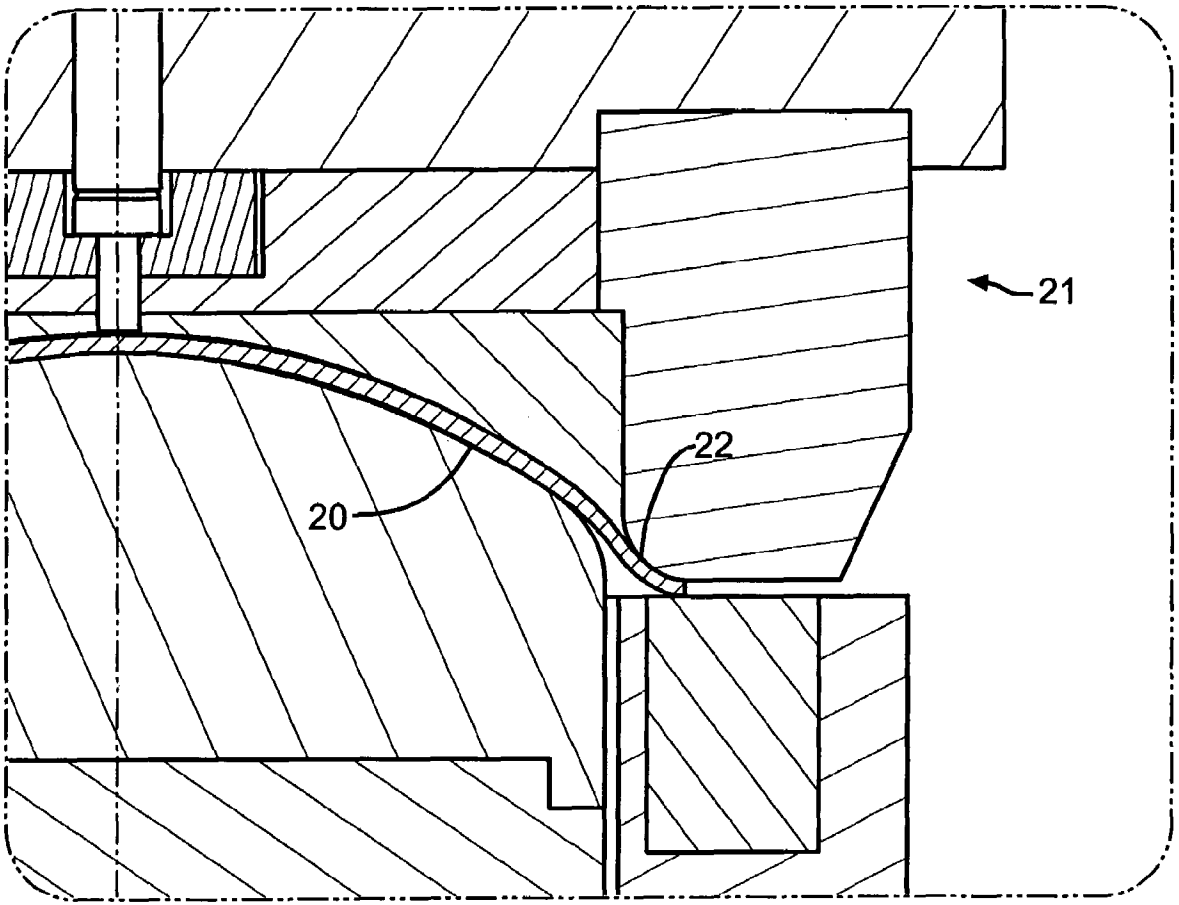

FIGS. 3 and 3A show a tooling set, indicated generally at 21, for performing a first operation on a wheel disc blank (not shown) to produce a wheel disc 20. Tooling set 21 is adapted to be mounted to a punch press (not shown) and performs a metal stamping operation easily appreciated by those skilled in the art from an inspection of FIG. 3. A generally flat circular blank (not shown) is loaded into tooling set 21 and then the press is moved into its closed configuration depicted in FIG. 3. As a result of the closing of the press, the central portion of wheel disc 20 is drawn vertically upward with respect to the outer periphery of wheel disc 20, creating a symmetrical bowl shape. This adds material volume needed for subsequent drawing steps and work hardens the material.

Preferably, a radius 22 is formed proximate to the outer edge of wheel disc 20. After completing the first operation shown in FIG. 3, tooling set 21 is opened and wheel disc 20 is transferred to a subsequent press for the next operation.

Figure 4:
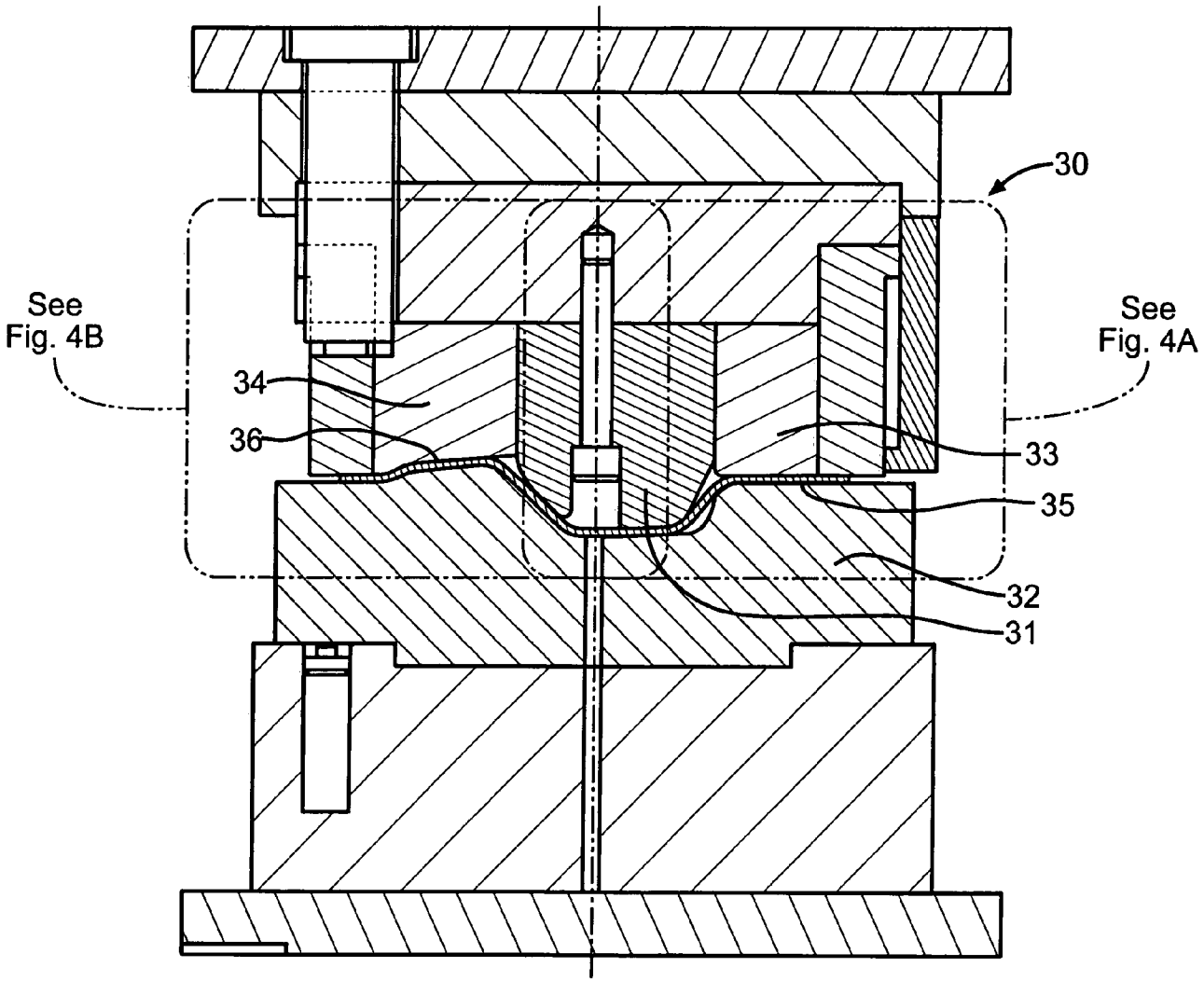
FIGS. 4, 4A, and 4B are cross-sectional views of a closed press after processing a wheel disc according to a second operation of the first embodiment of the present invention.
Figure 4A:
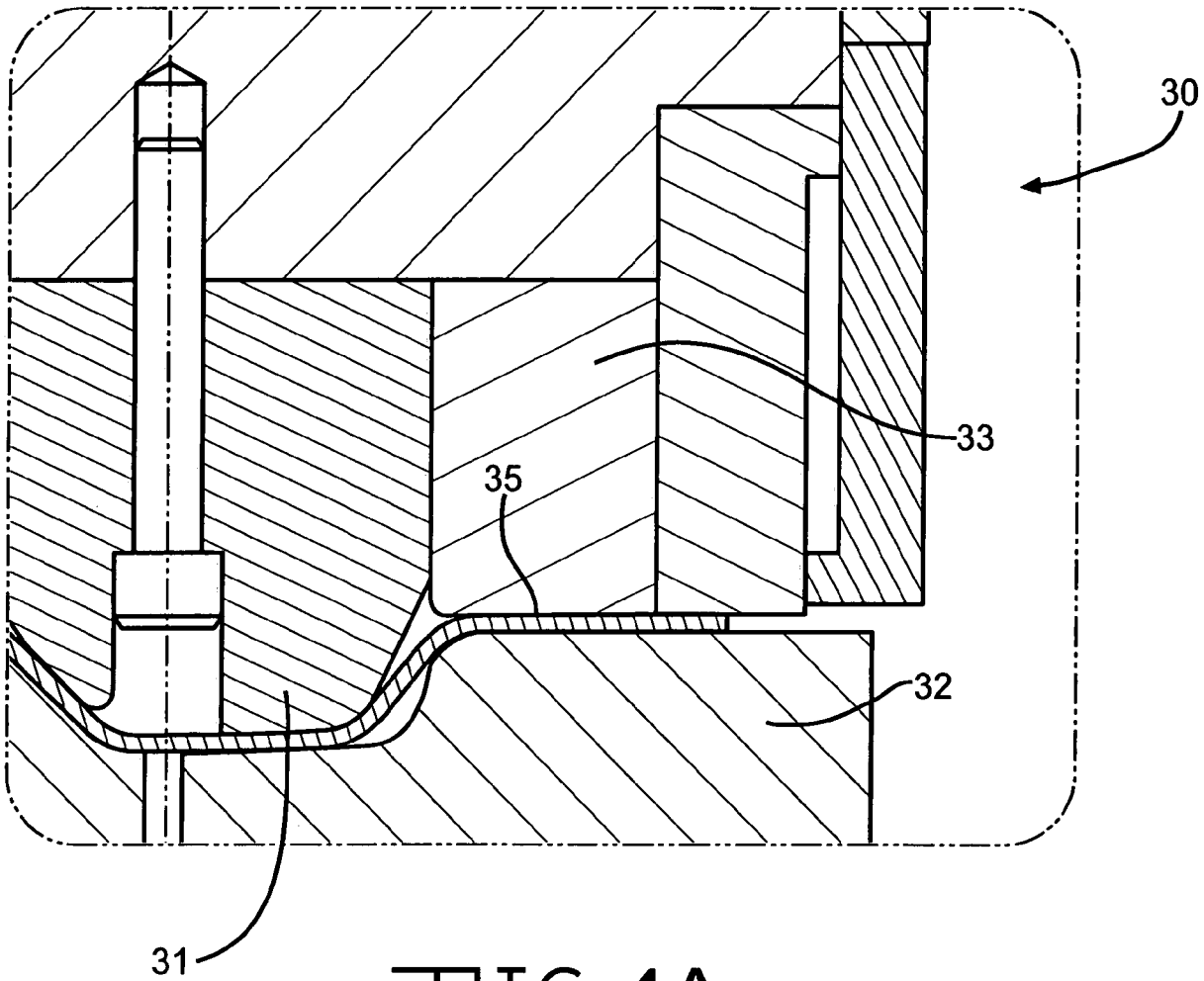
Figure 4B:
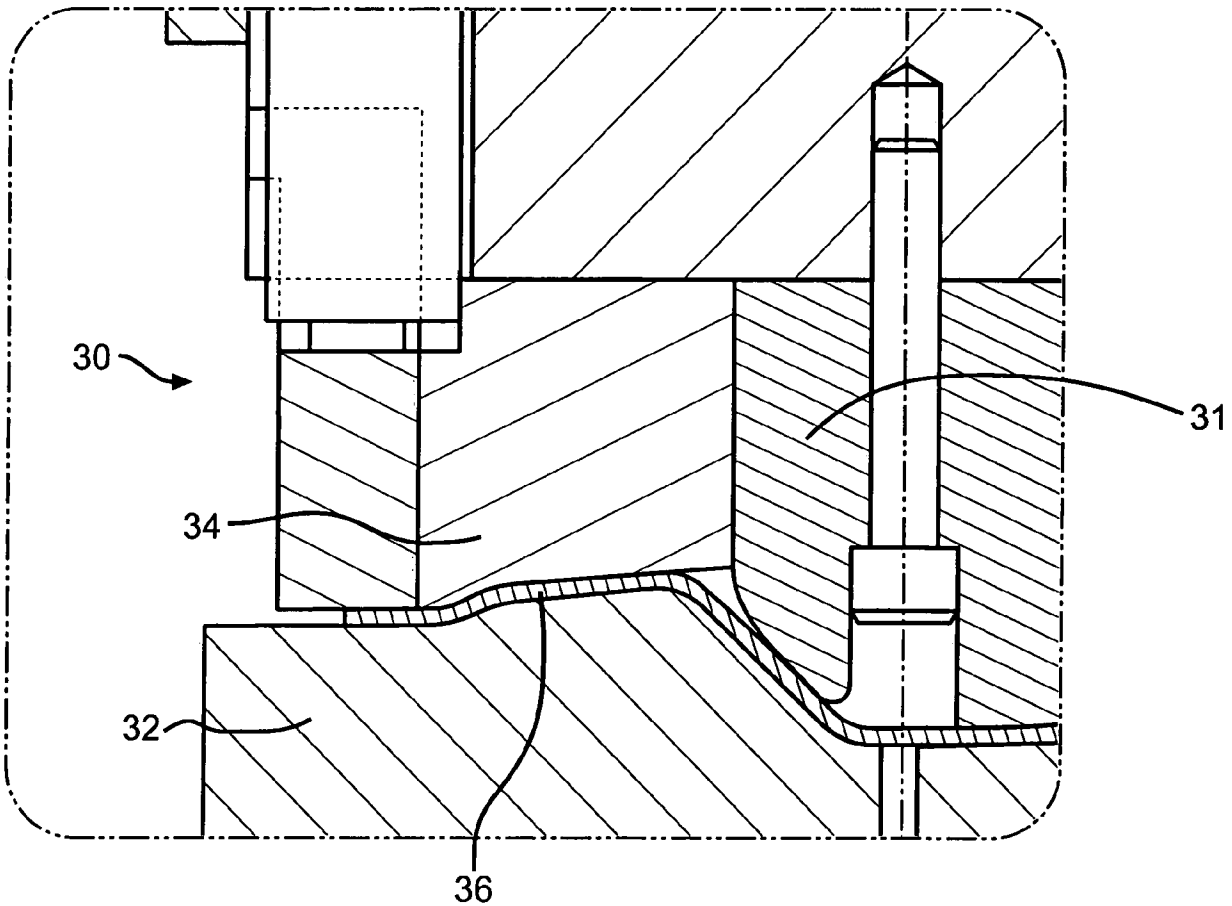

FIGS. 4, 4A, and 4B show a second operation wherein a tooling set, indicated generally at 30, performs further preliminary shaping of wheel disc 20. Die details 31 and 32 perform preliminary shaping in an inner wheel mounting area of disc 20. Die details 33 and 32 cooperate to stamp a spoke forming region 35. Die details 34 and 32 cooperate to stamp a window forming region 36. In the embodiment shown in FIGS. 1 and 2, a total of five spoke forming regions 35 and five window forming regions 36 are formed around the full periphery of wheel disc 20. In the illustrated embodiment, window forming regions 36 are shown with a greater stamped height than spoke-forming regions 35, but any other relative heights between the window and spoke forming regions are possible depending upon the desired final shape of the wheel disc. Although tooling set 30 is shown in cross section, one skilled in the art will appreciate that the die details have a three dimensional shape.

In the second pre-forming operation, the inner mounting area and regions 35 and 36 are preferably drawn downward with respect to the outer periphery of wheel disc 20 (i.e., in the opposite vertical direction). Consequently, further material redistribution and work hardening are achieved.

Figure 5:
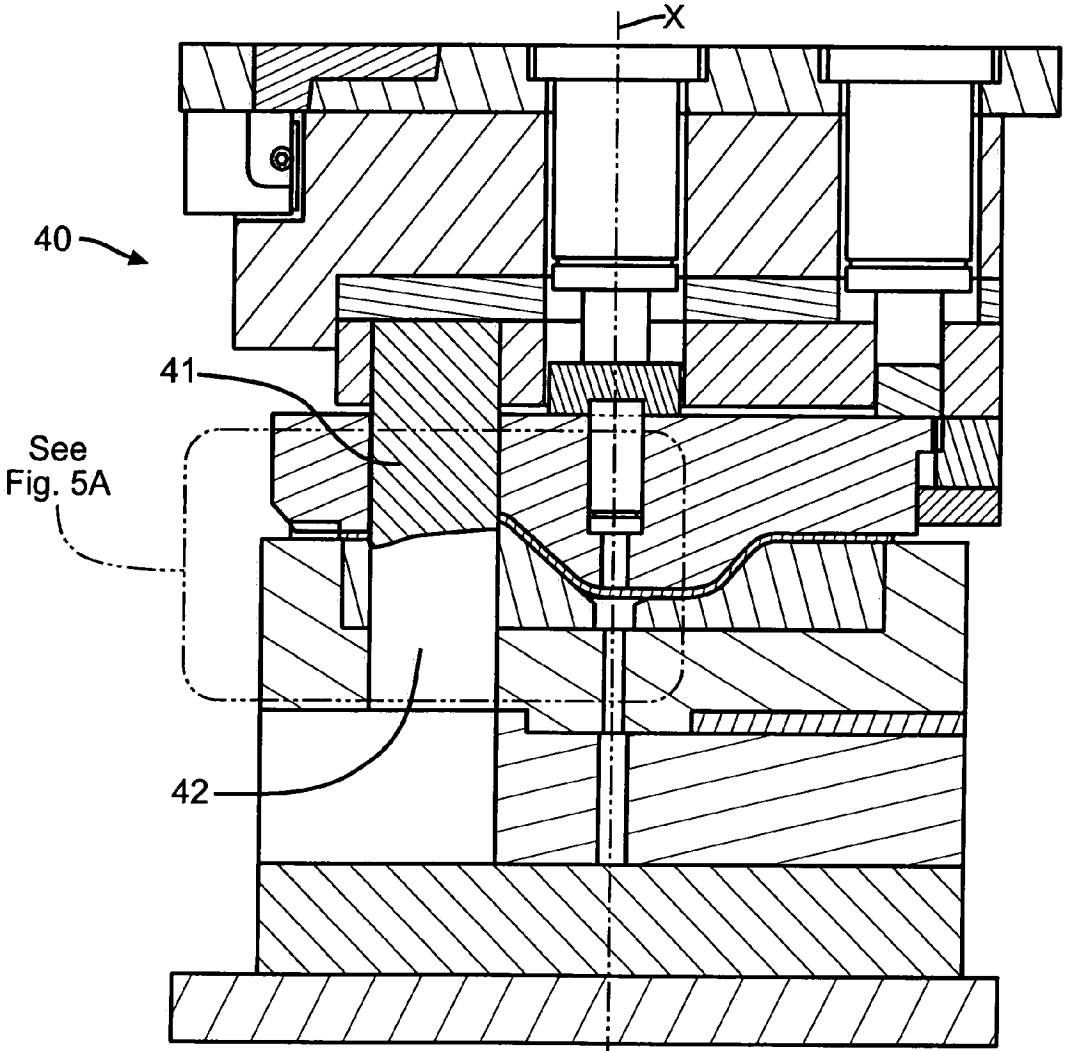
FIGS. 5, 5A, and 5B are cross-sectional views of a closed press after processing a wheel disc according to a third operation of the first embodiment of the present invention.
Figure 5A:
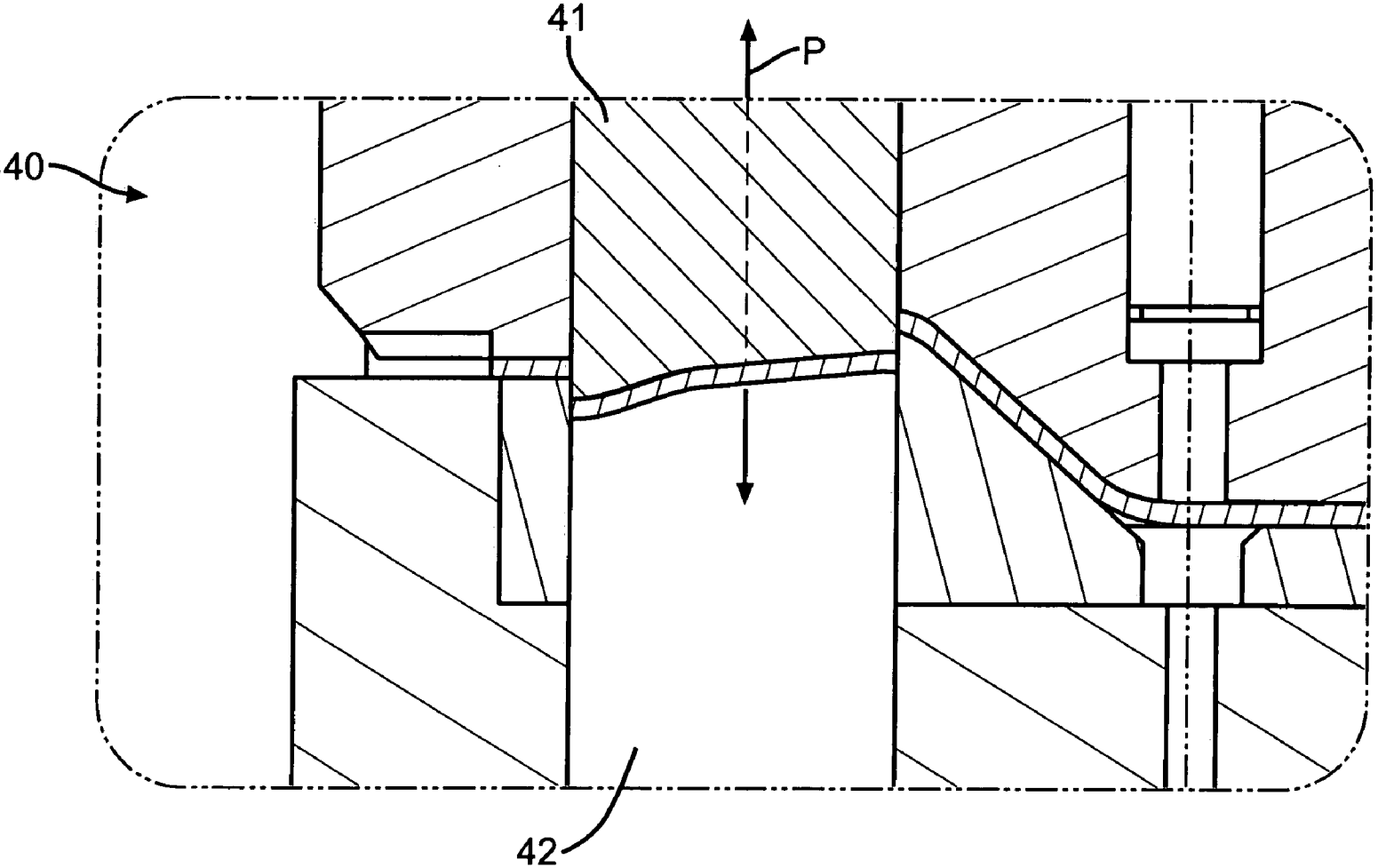

FIGS. 5 and 5A show a tooling set, indicated generally at 40, for a next operation conducted in a subsequent press to which wheel disc 20 is transferred for piercing windows in a substantially vertical direction. A punch detail 41 is driven into window forming regions 36 along a punch axis P which is generally parallel with respect to the wheel disc axis X, and the resulting slug is removed through a chute 42. As shown in this embodiment, the outer edge of wheel disc 20 extends substantially horizontally and is retained by tooling set 40 during the piercing operation so that the pierce can be conducted vertically, which simplifies the tooling set as opposed to making an aerial pierce at an angle.

Figure 5B:
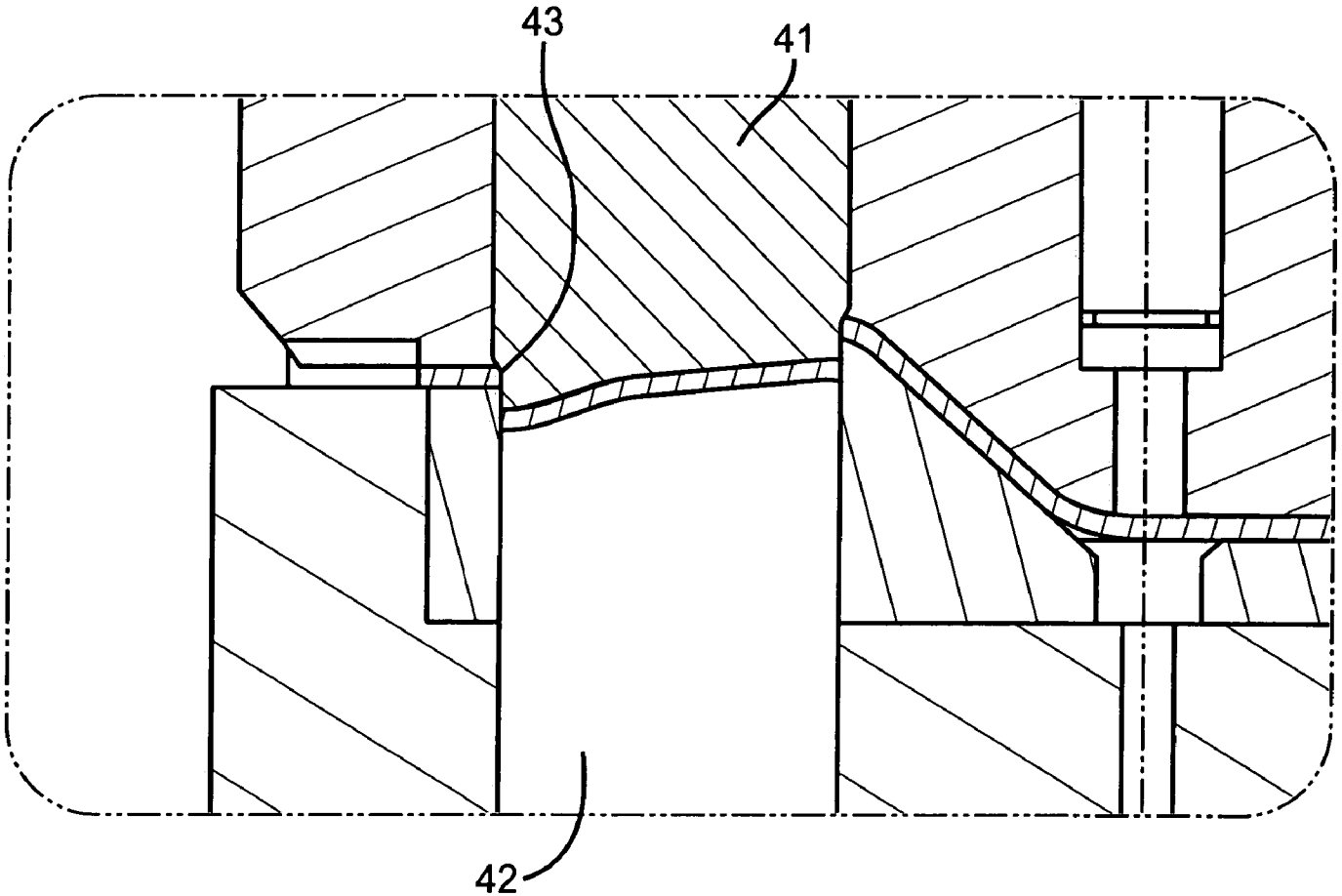

In the illustrated embodiment, the top side of the formed windows is preferably simultaneously coined as shown in FIG. 5B by providing a collar 43 on die detail 41 behind the leading or front cutting edge of die detail 41 (the collar 43 only being shown on die detail 41 in FIG. 5B). Collar 43 strikes along the edge of the pierced window as part of the same downward stroke of die detail 41. Alternatively, the coining of the pierced windows can be performed by other methods subsequent to this operation if so desired.

Figure 6:
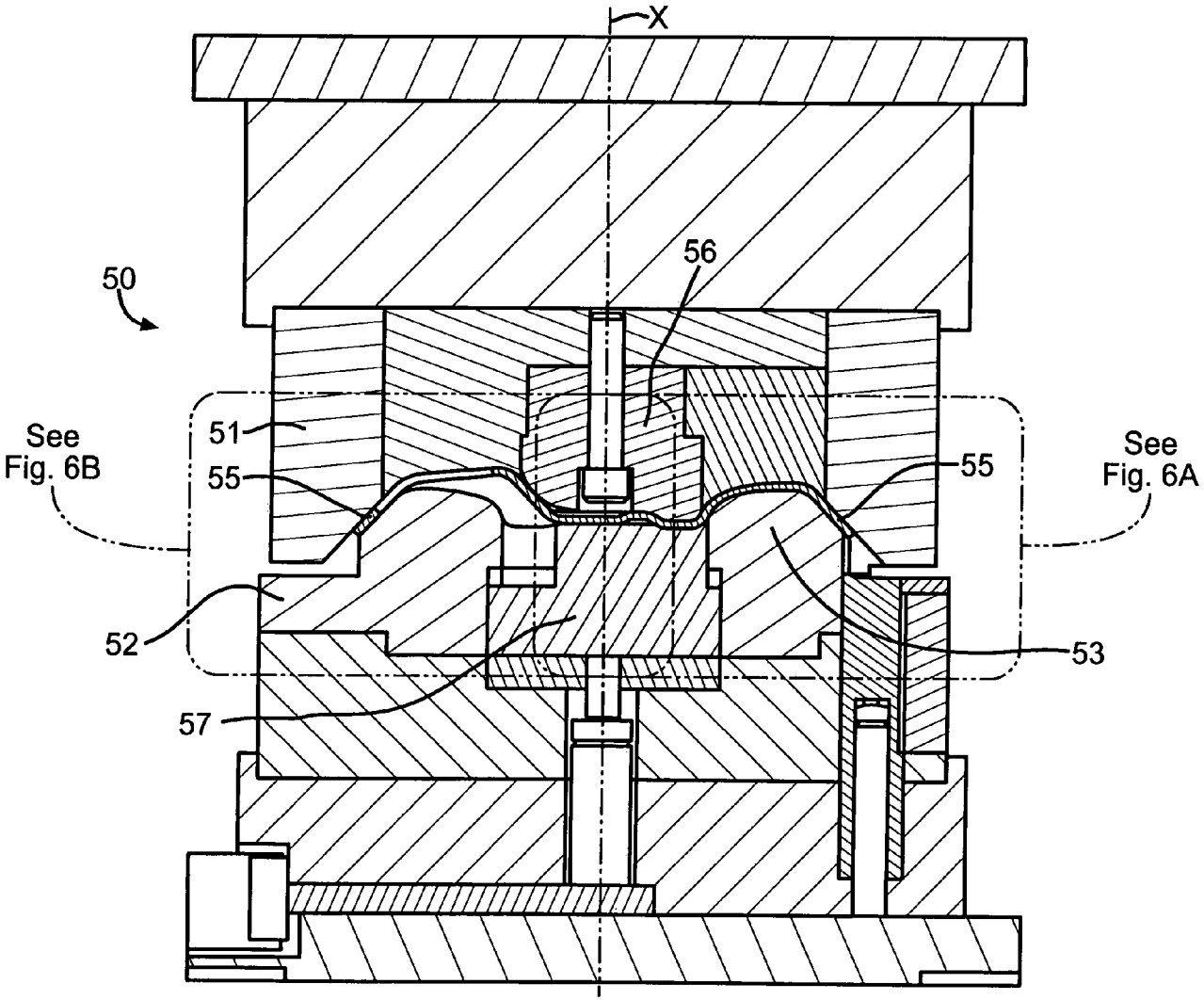
FIGS. 6, 6A, and 6B are cross-sectional views of a closed press after processing a wheel disc according to a fourth operation of the first embodiment of the present invention.
Figure 6A:
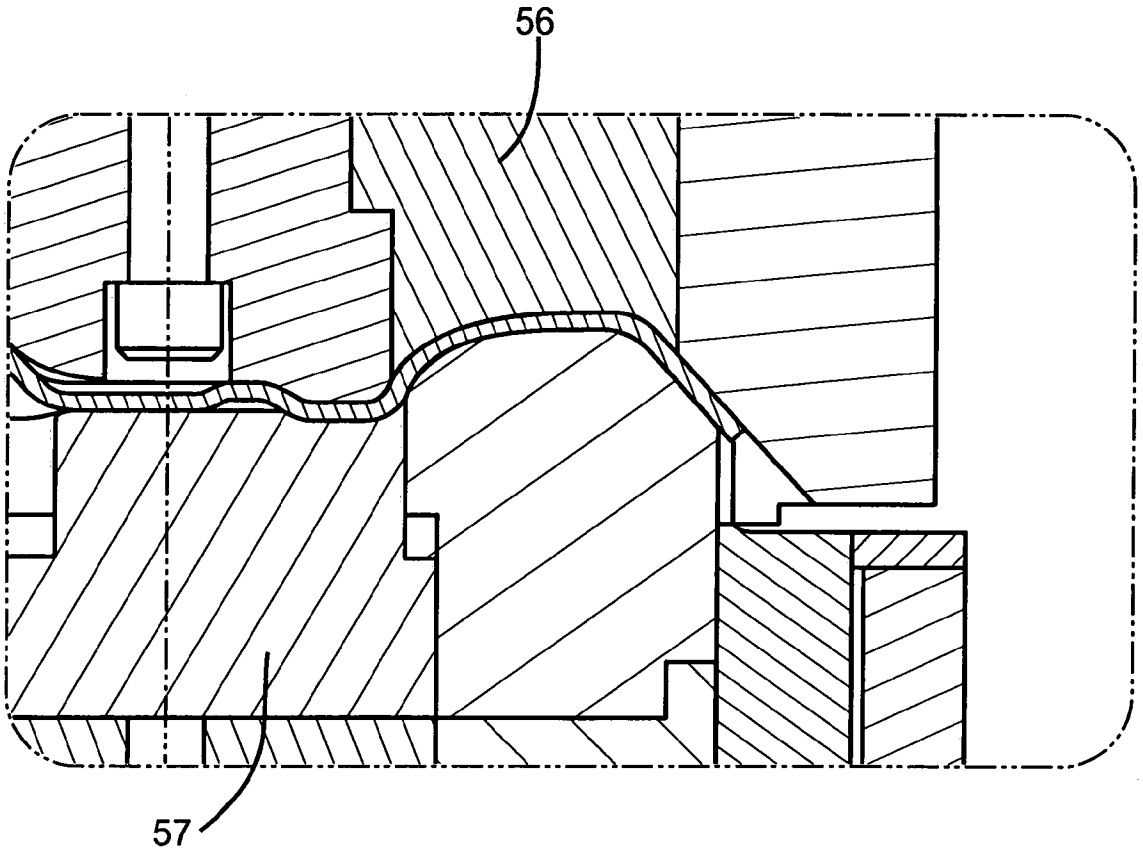

The next operation shown in FIGS. 6 and 6A performs further disc shaping using a tooling set, indicated generally at 50. Tooling set 50 includes an upper ring 51 and a die detail 52 providing an anvil 53. Complementary sloped edges of upper ring 51 and anvil 53 shape outer band 55 into an angled leg. Preferably, the angled leg of outer band 55 is oriented at about twenty degrees from the wheel disc axis X (i.e., the central vertical axis). It is desirable to draw down outer band 55 no more than about twenty degrees to avoid stressing the spoke transitions or causing unwanted undulations. Additionally, in the illustrated embodiment, it is preferred that the upper ring 51 and anvil 53 are shaped so as to induce or produce counter undulations in the outer band 55 which are effective to reduce or cancel out the self induced undulations which occur during this operation.

In the illustrated embodiment, additional die details 56 and 57 are preferably provided to simultaneously perform a final shaping of wheel disc 20 to provide areas to receive a central hole and a plurality of lug bolt holes. Final shaping adjustments may also be obtained in the areas of the spokes and windows if desired. Alternatively, the final shaping of the wheel disc 20 in the areas to receive the central hole and the lug bolt holes can be performed by other methods subsequent to this operation if so desired.

Figure 7:
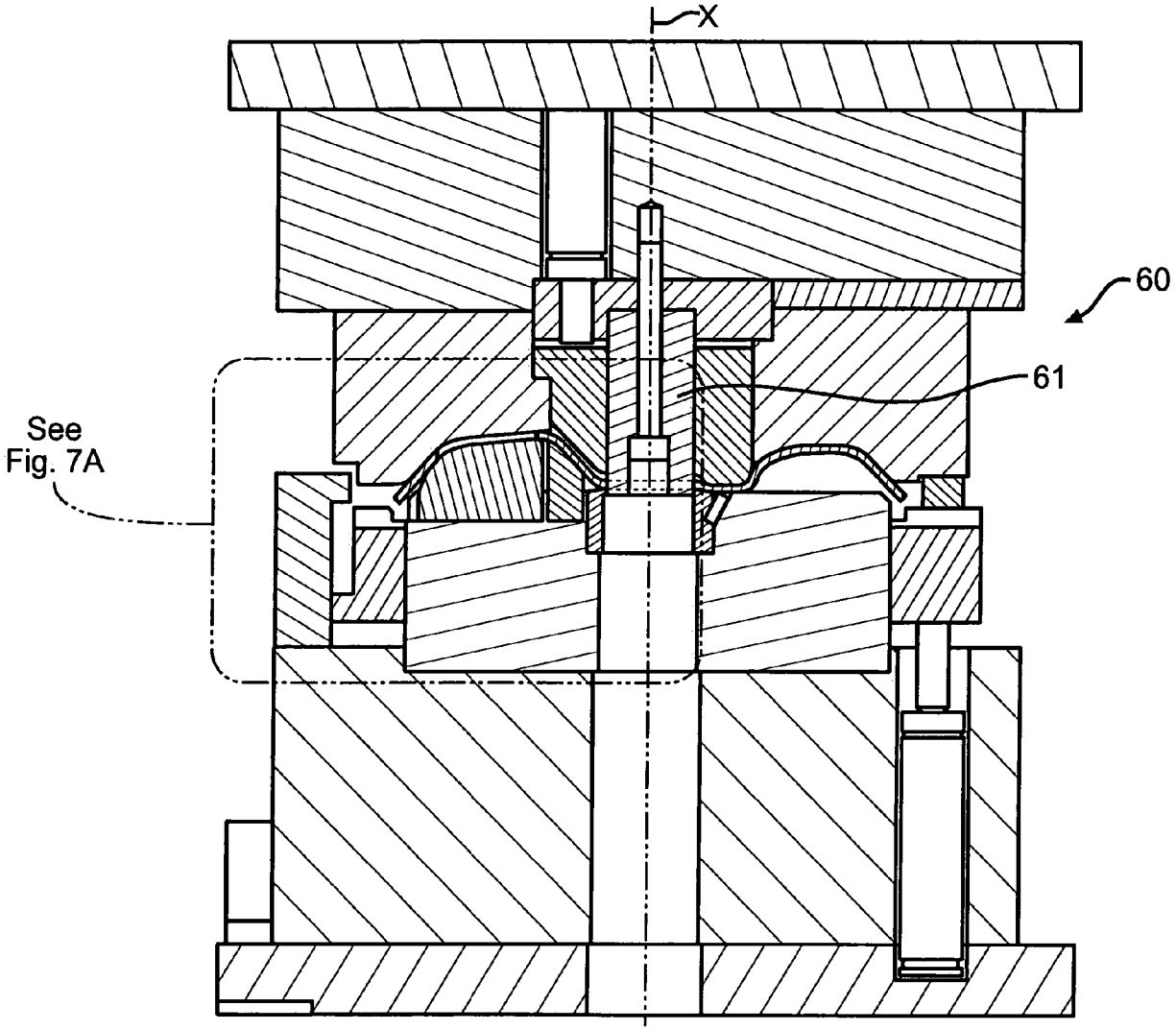
FIGS. 7 and 7A are cross-sectional views of a closed press after processing a wheel disc according to a fifth operation of the first embodiment of the present invention.
Figure 7A:
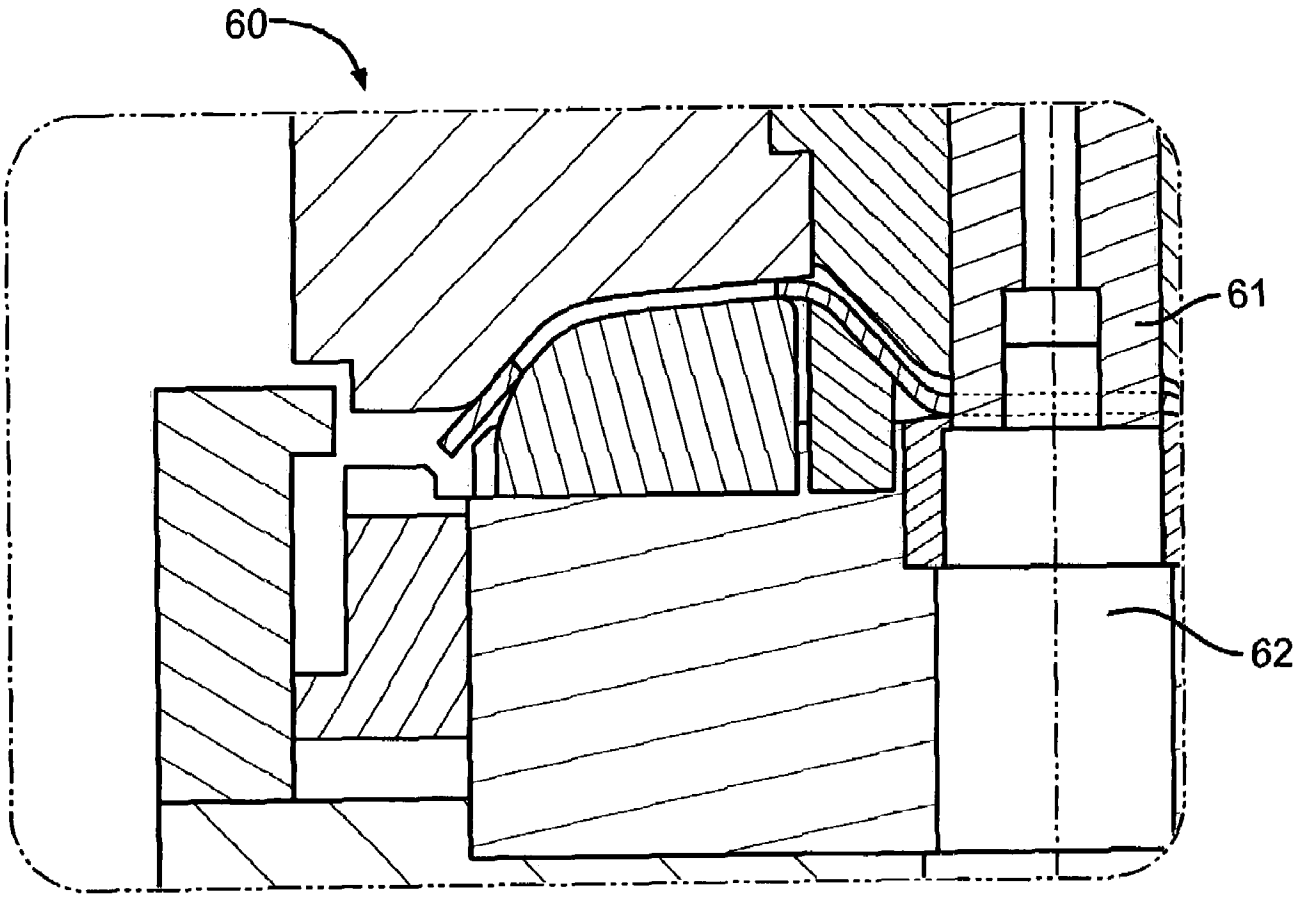

In the subsequent operation shown in FIGS. 7 and 7A, the central hole is pierced using a tooling set, indicated generally at 60. Specifically, a die detail 61 is driven through wheel disc 20 and a resulting slug is removed through a chute 62.

Figure 8:
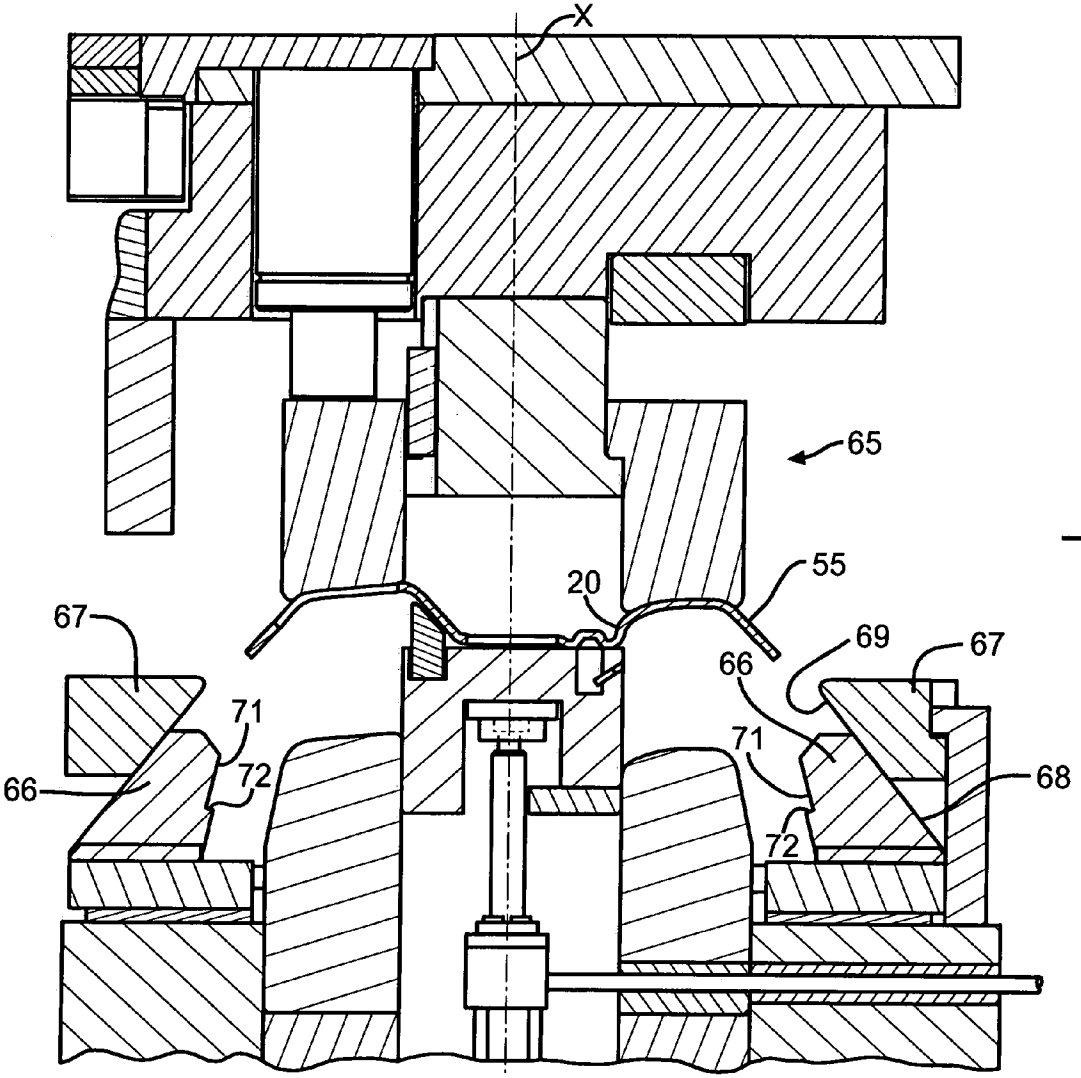
FIG. 8 is a cross-sectional view of an open press before processing a wheel disc according to a sixth operation of the first embodiment of the present invention.
Figure 8A:
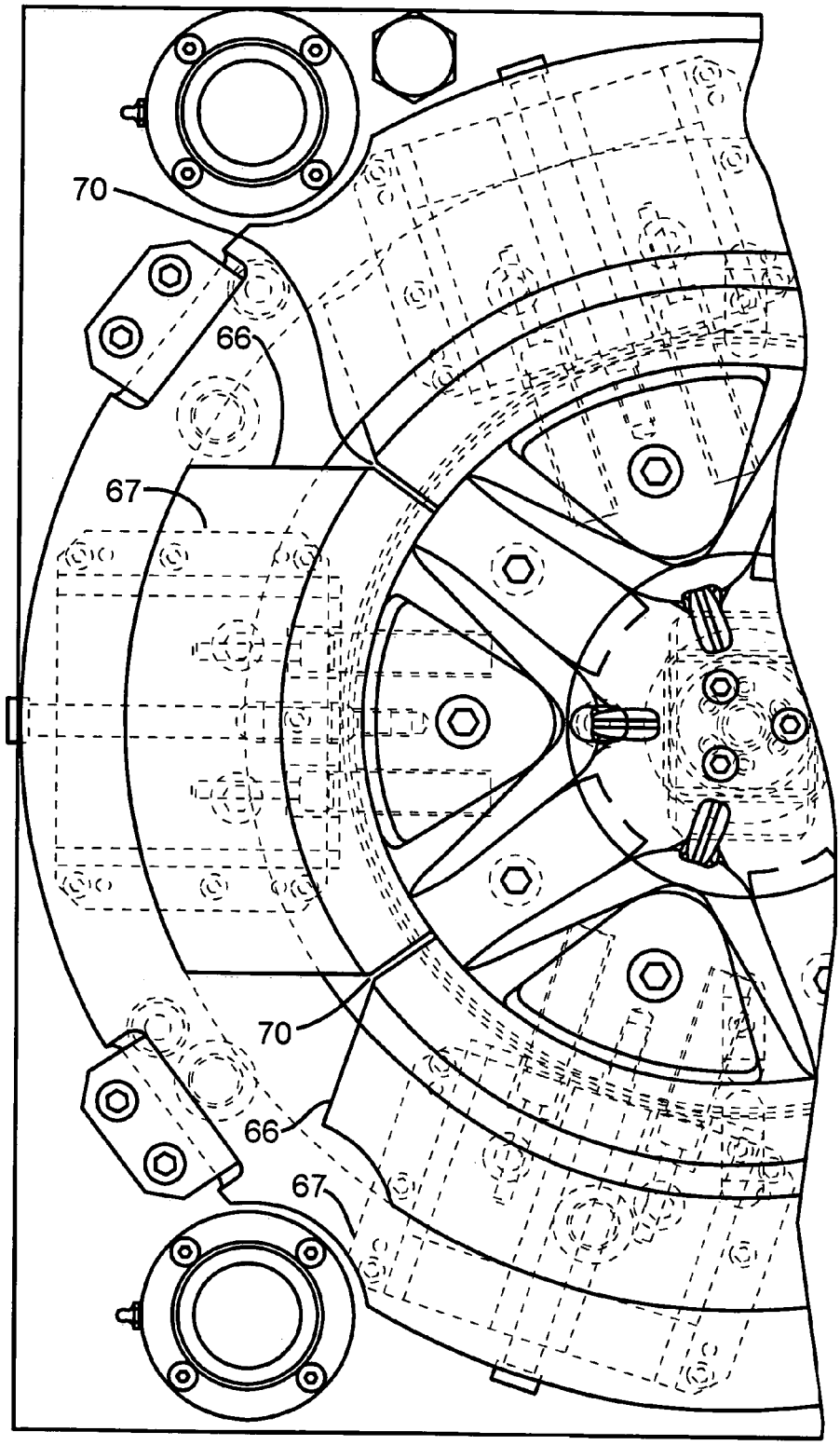
FIG. 8A is a top plan view of a portion of the die set of the sixth operation.

The next operation shown in FIGS. 8, 8A, 8B, and 8C partially closes the outer band using a tooling set, indicated generally at 65. Tooling set 65 is shown in FIG. 8A in its open configuration holding wheel disc 20 in position to allow outer band 55 to be bent to a more nearly cylindrical shape following the closing of the tooling set 65. Tooling set 65 includes a cam die detail 66 which can be driven radially inward by a cam driver 67. Slanted surfaces 68 and 69 on cam die detail 66 and cam driver 67, respectively, are oriented such that when cam driver 67 is forced downward, cam die detail 66 is driven radially inward.

Preferably, cam die detail 66 and cam driver 67 each comprise several separate circumferentially spaced segments to accommodate the change in radius as cam die detail 66 moves inward to simultaneously cam respective portions of outer band 55. As shown in FIG. 8A, relatively small gaps 70 between separate cam sections may be about one quarter of an inch at the smaller radius. Gaps 70 may preferably be located corresponding to points on the perimeter away from the spokes (i.e., juxtaposed with the windows) since no significant bending is needed there.

Cam die detail 66 has a slanted engagement surface 71 with an intermediate horizontal ledge 72 for receiving a peripheral edge of outer band 55 to reduce undulations which may be otherwise formed in outer band 55. After wheel disc 20 is lowered into the tooling set 65 and cam die detail 66 begins to move radially inward, the peripheral edge of outer band 55 makes contact with engagement surface 71. Outer band 55 bends downward while the peripheral edge slides down surface 71 until it makes contact with ledge 72. As the peripheral edge of outer band 55 presses against ledge 72, outer band 55 continues to bend downward and any undulations which may be present are evened out or removed because of the constraint in the leg length of the outer band 55 resulting from the presence of ledge 72.

Figure 8B:
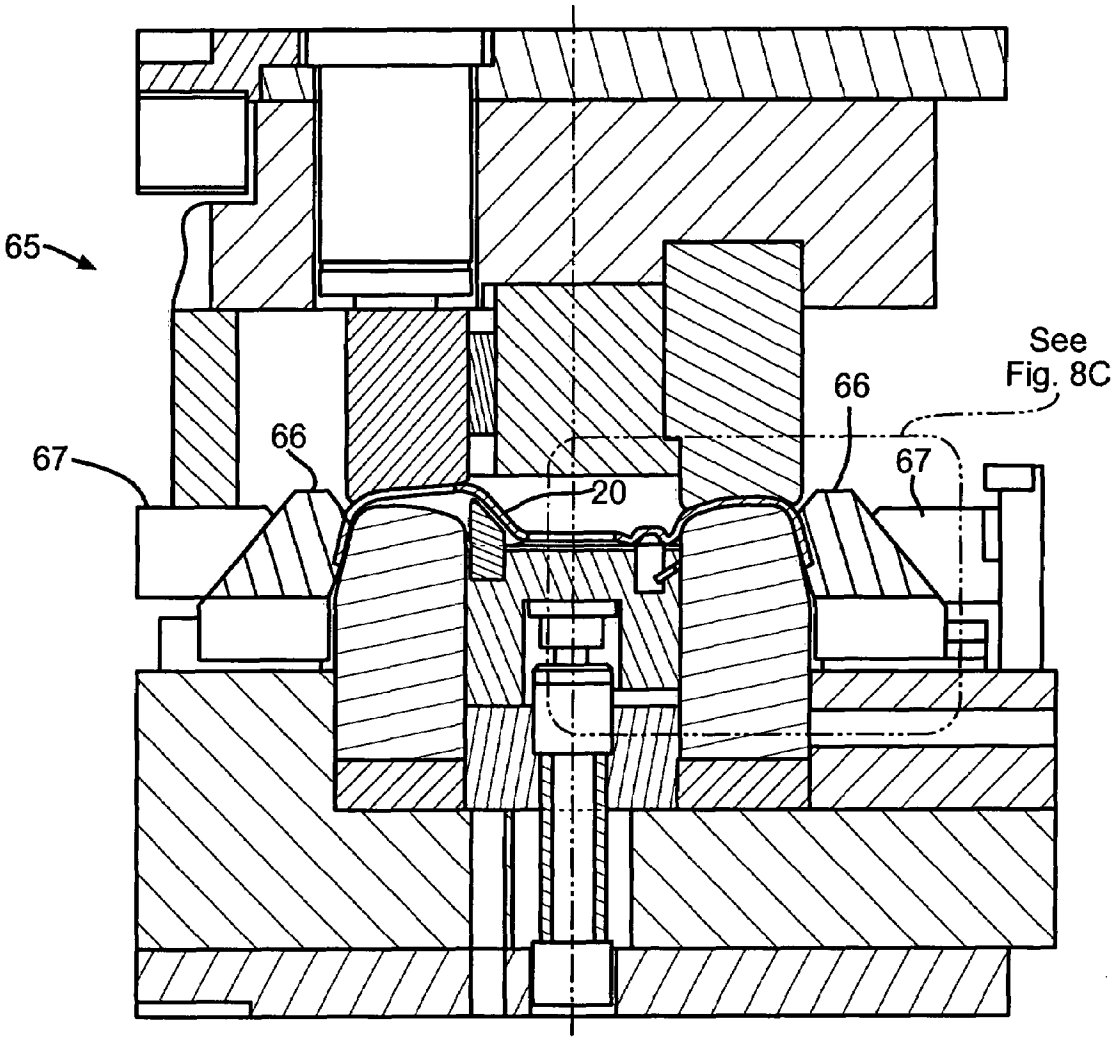
FIGS. 8B and 8C are cross-sectional views of a closed press after processing a wheel disc according to the sixth operation.
Figure 8C:
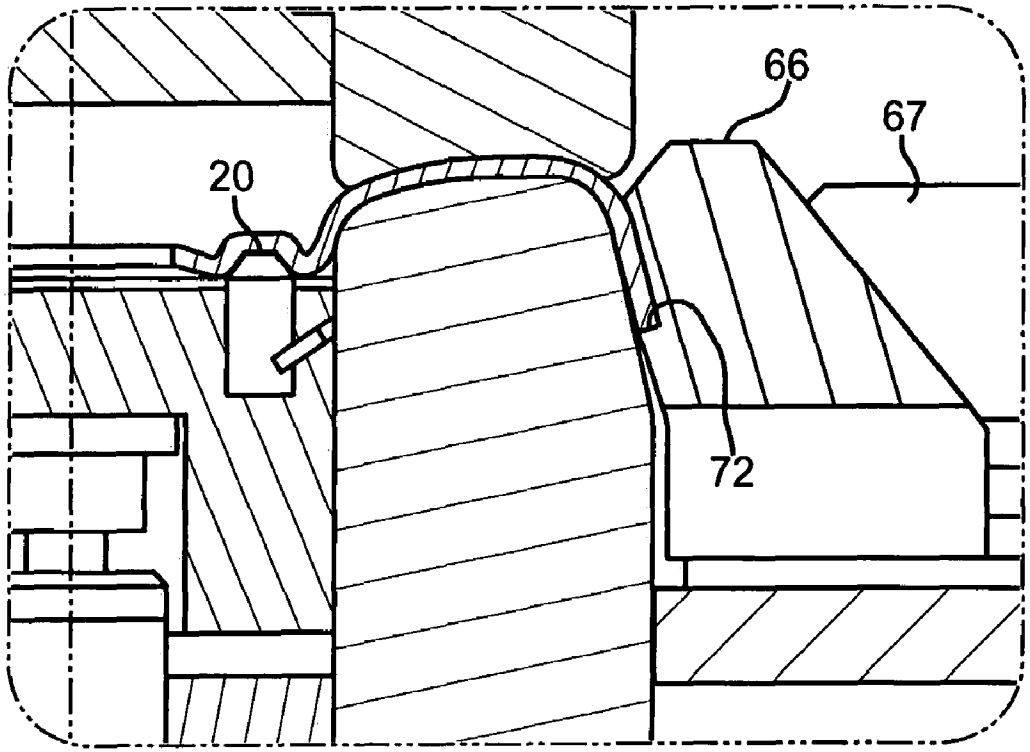

FIGS. 8B and 8C show cam die detail 66 in its closed radially inward position after having driven outer band 55 radially inward to partially close it. After camming over outer band 55, driver 67 is moved upward to withdraw cam die detail 65 to its radial outward position so that wheel disc 20 may be transferred to the next operation.

Figure 9:
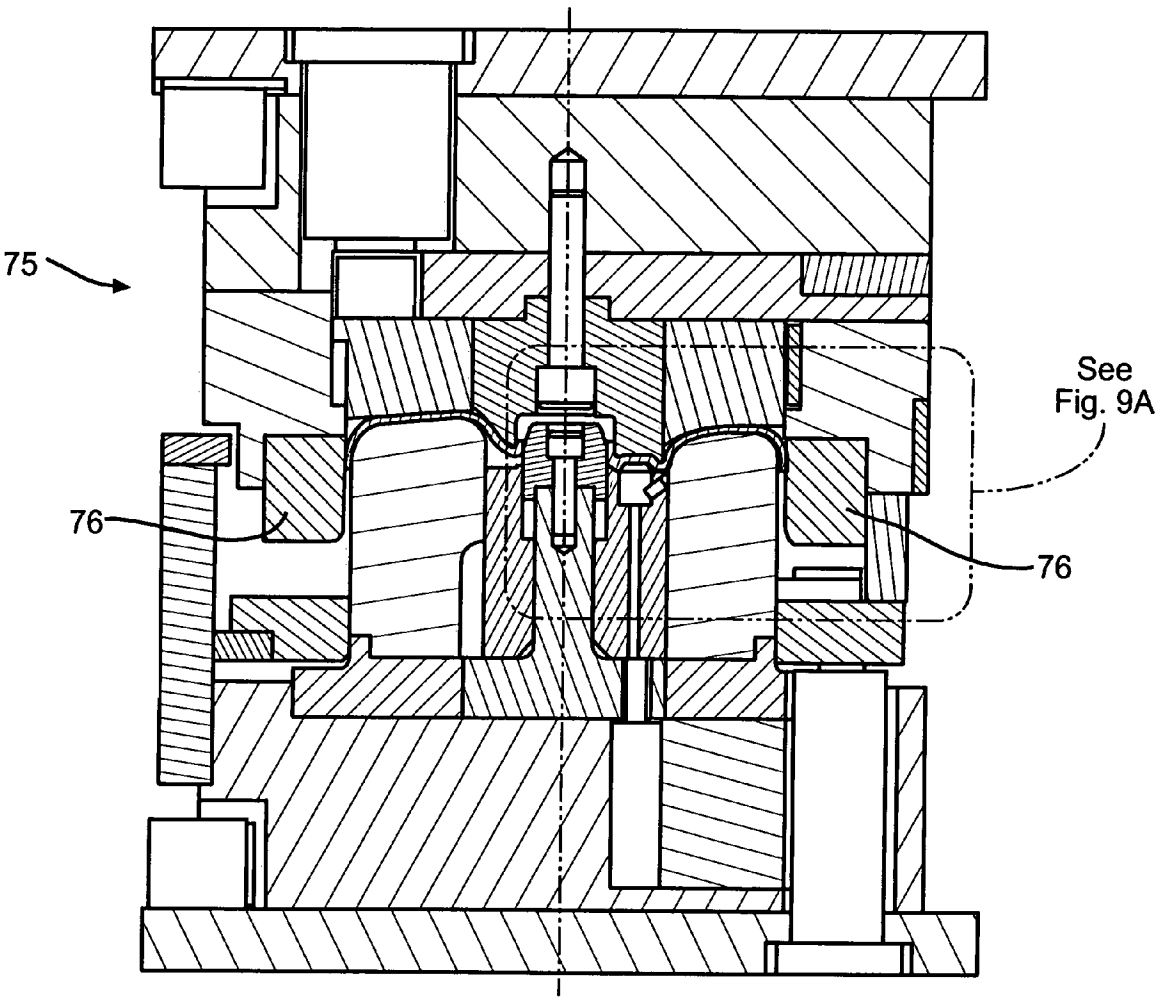
FIGS. 9 and 9A are cross-sectional views of a closed press after processing a wheel disc according to a seventh operation of the first embodiment of the present invention.
Figure 9A:
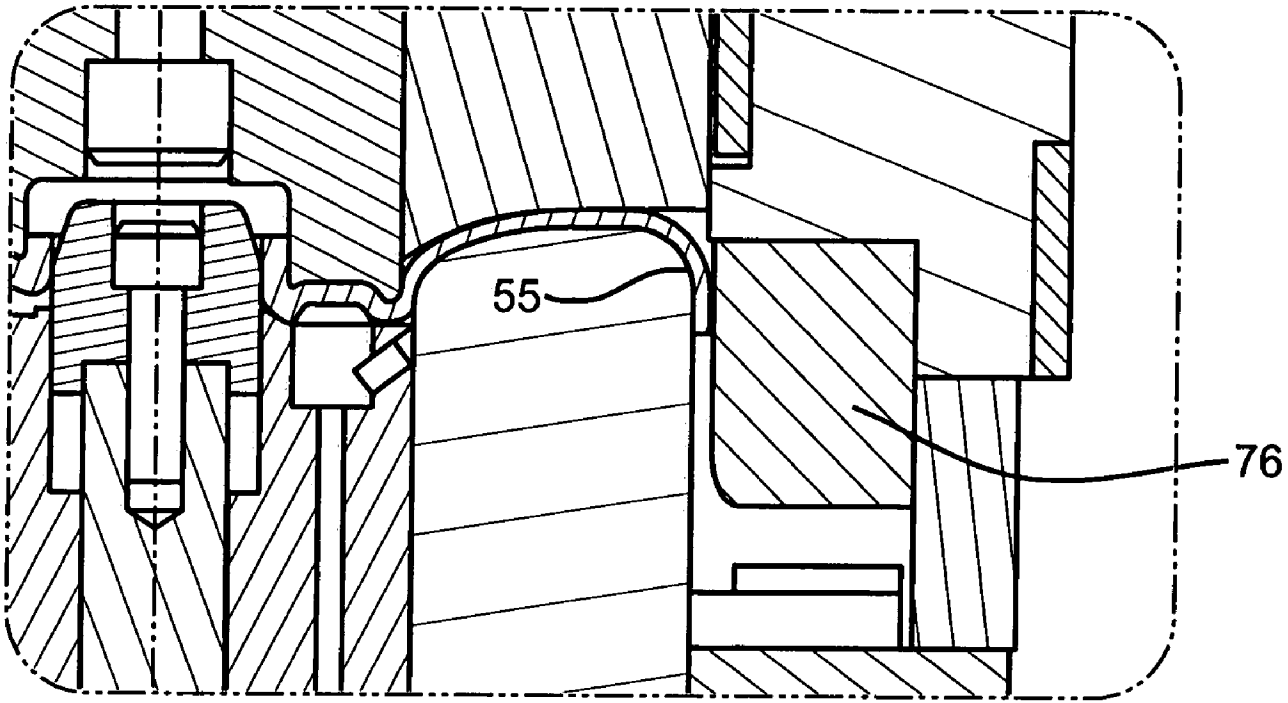

FIGS. 9 and 9A show a tooling set, indicated generally at 75, for fully closing the outer band into a generally cylindrical flange. More specifically as shown in the illustrated embodiment, a wipe die detail 76 moves downward to axially wipe outer band 55 so that it is drawn down to an approximately ninety degree angle from its original horizontal orientation. A generally cylindrical surface parallel with the wheel axis is formed for mating with the interior side of the rim.

Figure 10:
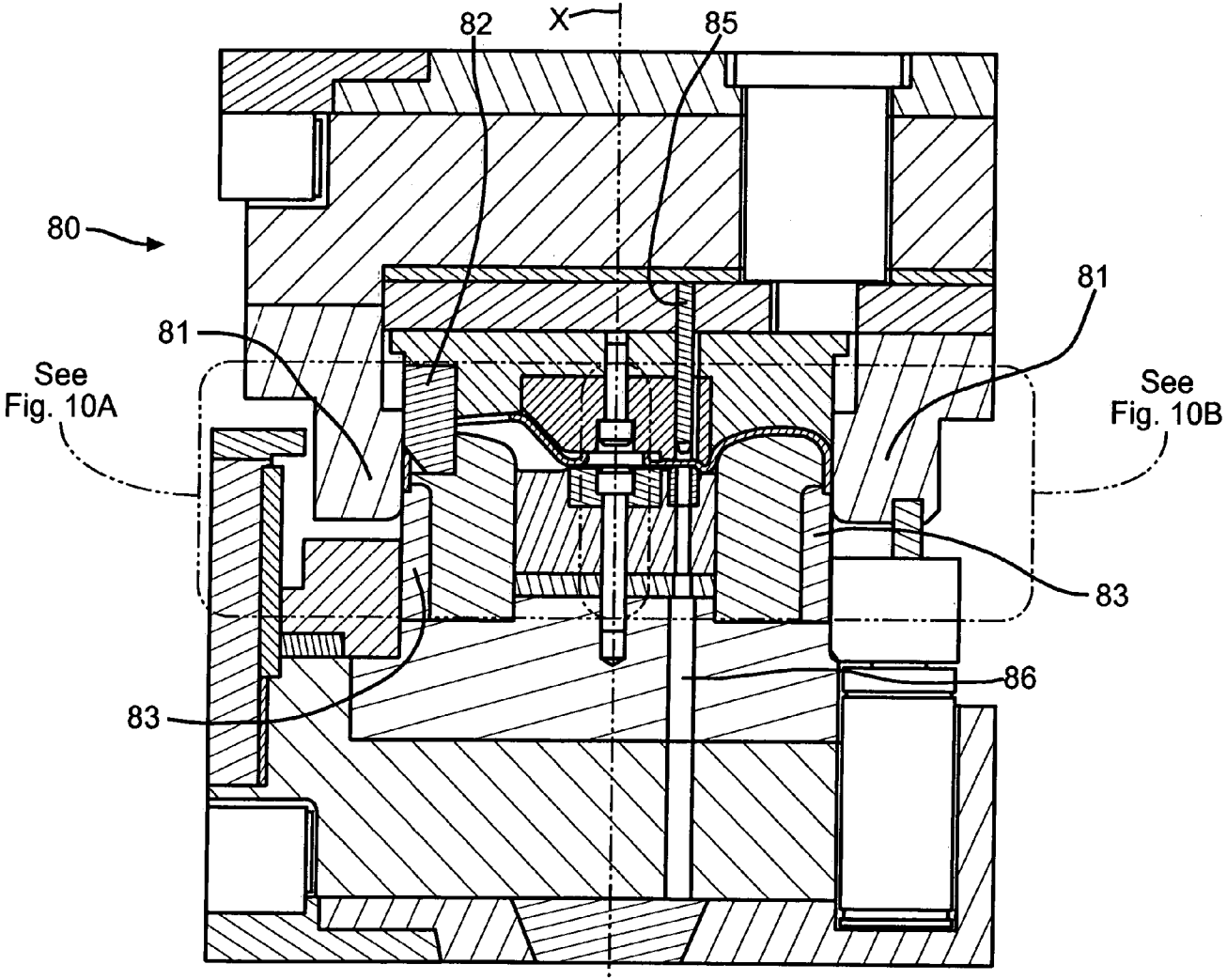
FIGS. 10, 10A, and 10B are cross-sectional views of a closed press after processing a wheel disc according to an eighth operation of the first embodiment of the present invention.
Figure 10A:
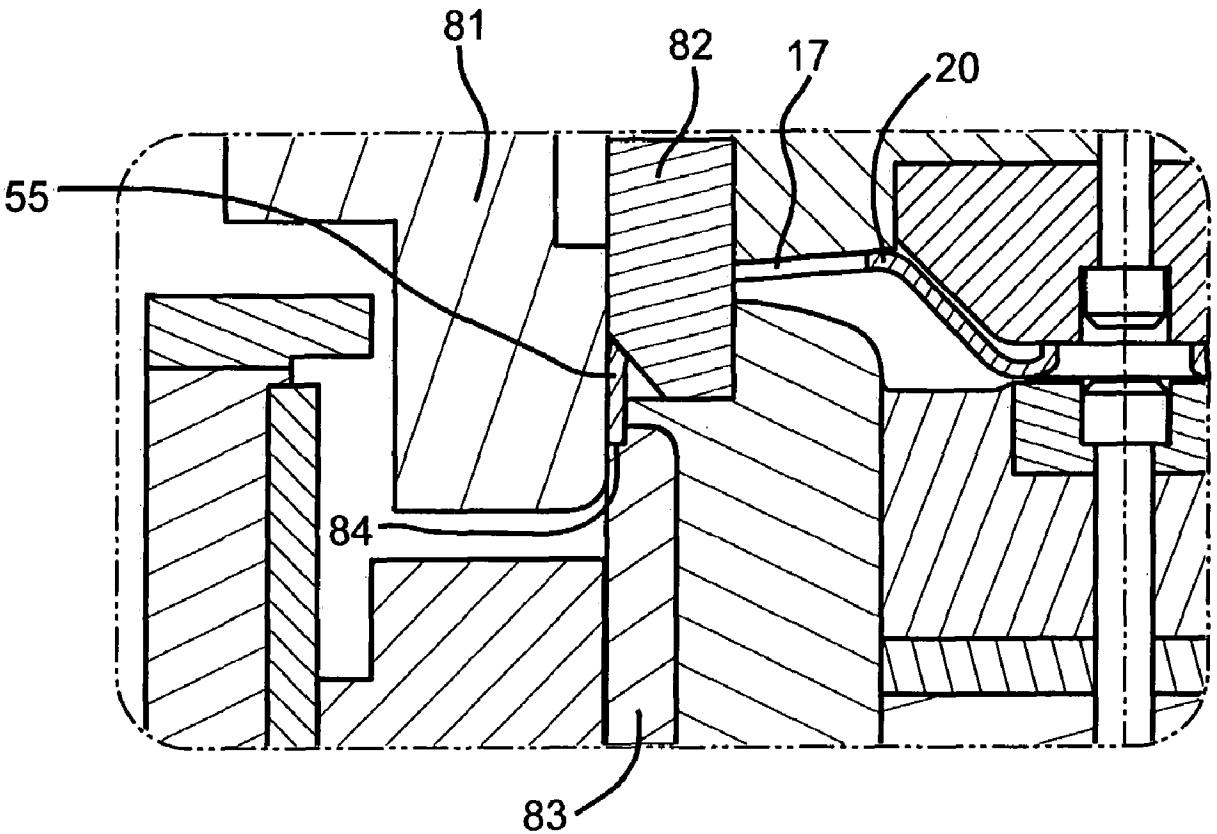
Figure 10B:
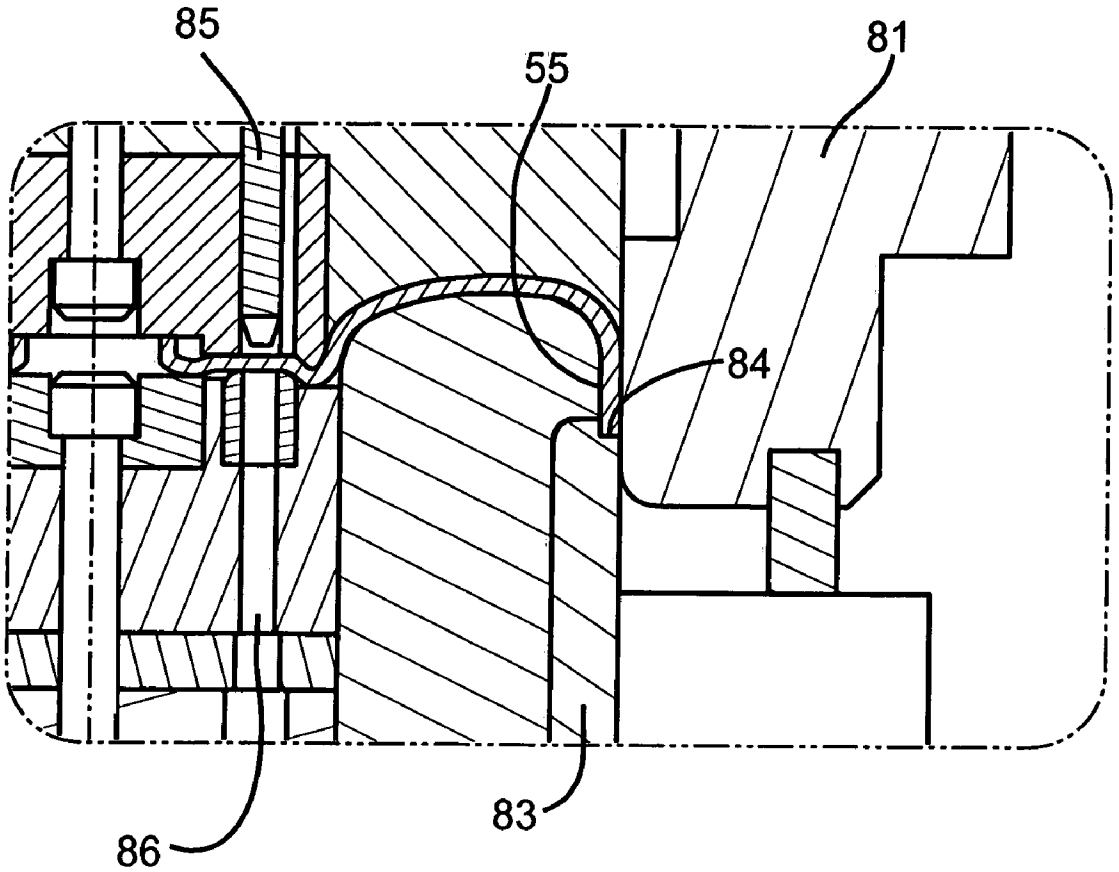

FIGS. 10, 10A, and 10B show the next operation wherein the downward leg length of outer band 55 is calibrated to a more accurately controlled final length. In addition, any remaining undulations may be further reduced. A tooling set, indicated generally at 80 (shown closed), includes die details 81 and 82 for retaining wheel disc 20 in position while a calibration die detail 83 strikes the peripheral edge of outer band 55 in a direction generally parallel to the wheel disc axis X. Die detail 82 penetrates or is disposed within window 17 in order to accurately locate wheel disc 20 for the calibration. As shown in FIGS. 10A and 10B, die detail 83 includes a ledge 84 for receiving the peripheral edge of outer band 44. Die detail 83 may be segmented around the periphery of tooling set 80 provided that gaps between segments are sufficiently small so that all portions of outer band 55 are correctly calibrated.

Simultaneous with the outer band calibration, one or more "process holes" may be created around the periphery of the center hole by a punch die detail 85. Slugs from the holes are removed via a chute 86. The process hole(s) are used in locating and handling the wheel disc during subsequent machining steps. The number and location of the process holes depends upon the specific requirements of the subsequent processing steps. Preferably, the process holes coincide with lug bolt hole locations so that no process holes are remaining in the final wheel disc.

In the illustrated preferred embodiment, the forming of the wheel disc is completed after calibrating outer band 55 as shown in FIG. 10. Subsequently, the wheel disc is attached to the wheel rim by welding, riveting or other suitable attachment (e.g., adhesive or by other mechanical means) and then the rim and wheel disc are trued (e.g., squeezed in a true-centric machine at the bead seats thereby pressing the wheel into a round shape with very high accuracy). Thereafter, the wheel disc is machined (e.g., using a mill) in order to accurately locate the center hole. The center hole may then be expanded and/or coined in a press while final lug bolt holes are punched. In an alternative embodiment, the final center hole and lug bolt holes can be formed in the wheel disc in a punch press prior to attaching to the rim.

Figure 6B:
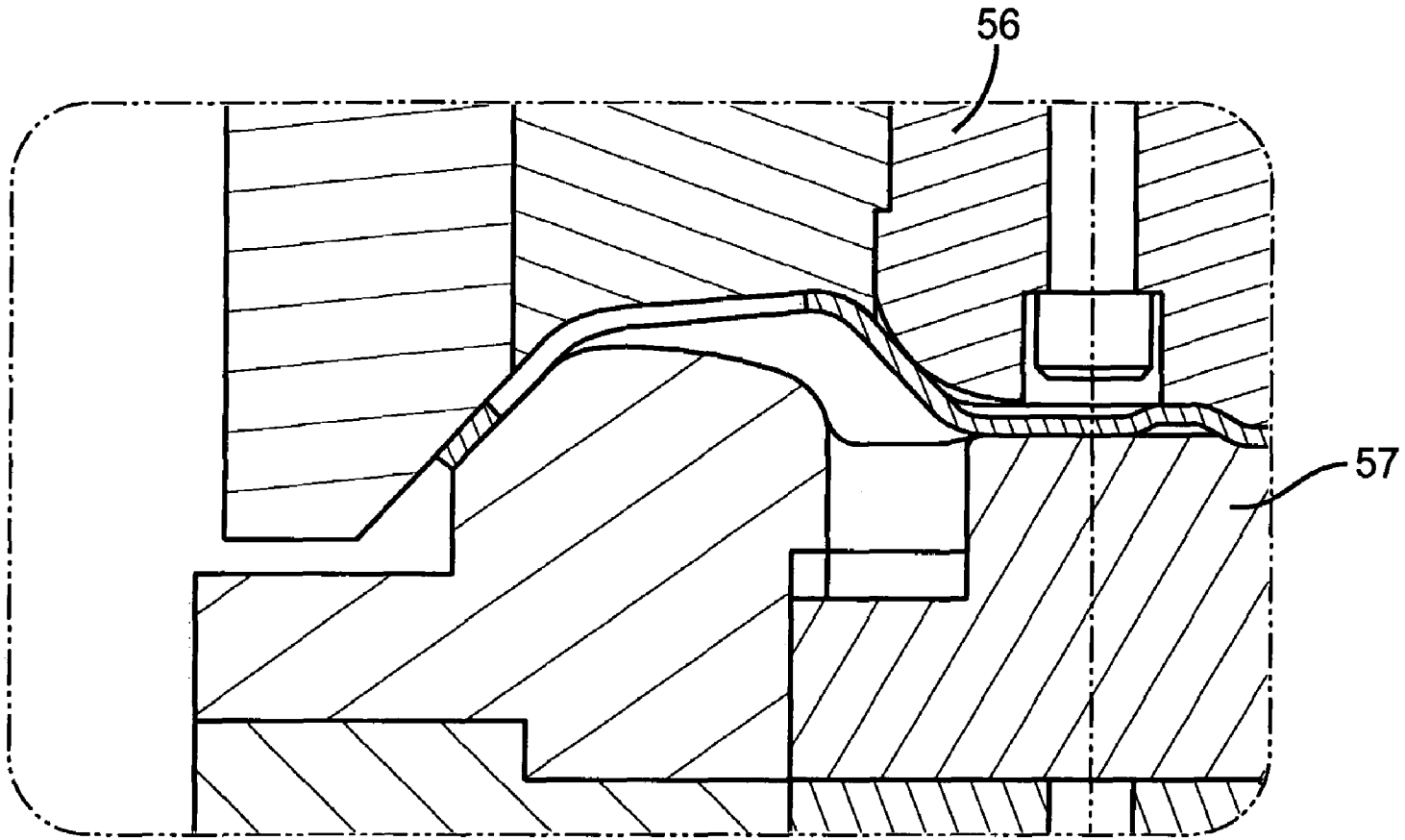
Figure 11:
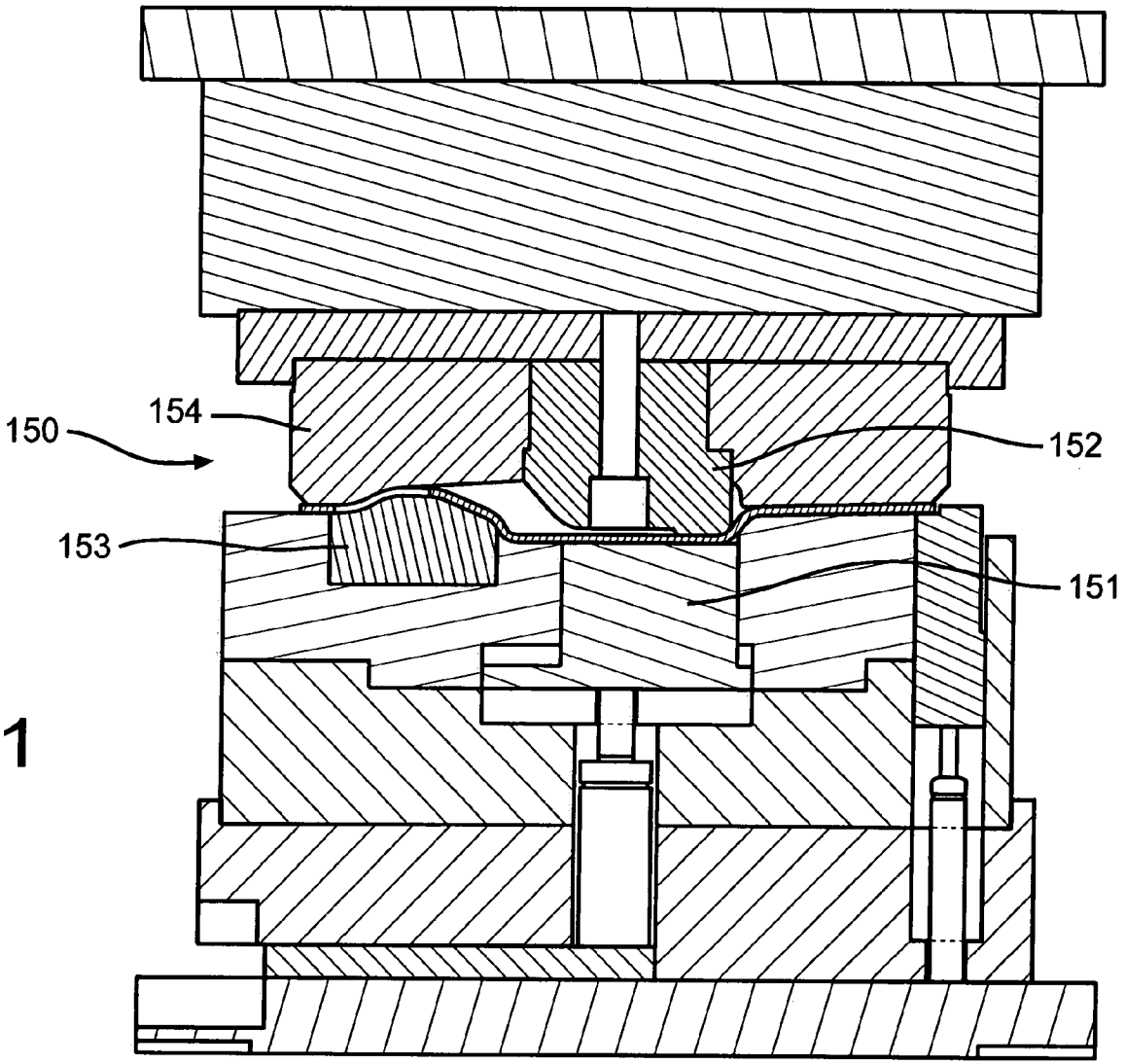
FIG. 11 is a cross-sectional view of a closed press after processing a wheel disc according to a fourth operation of a second embodiment of the present invention which may replace the fourth operation shown in FIGS. 6, 6A and 6B in connection with the first embodiment of the present invention.
Figure 12:
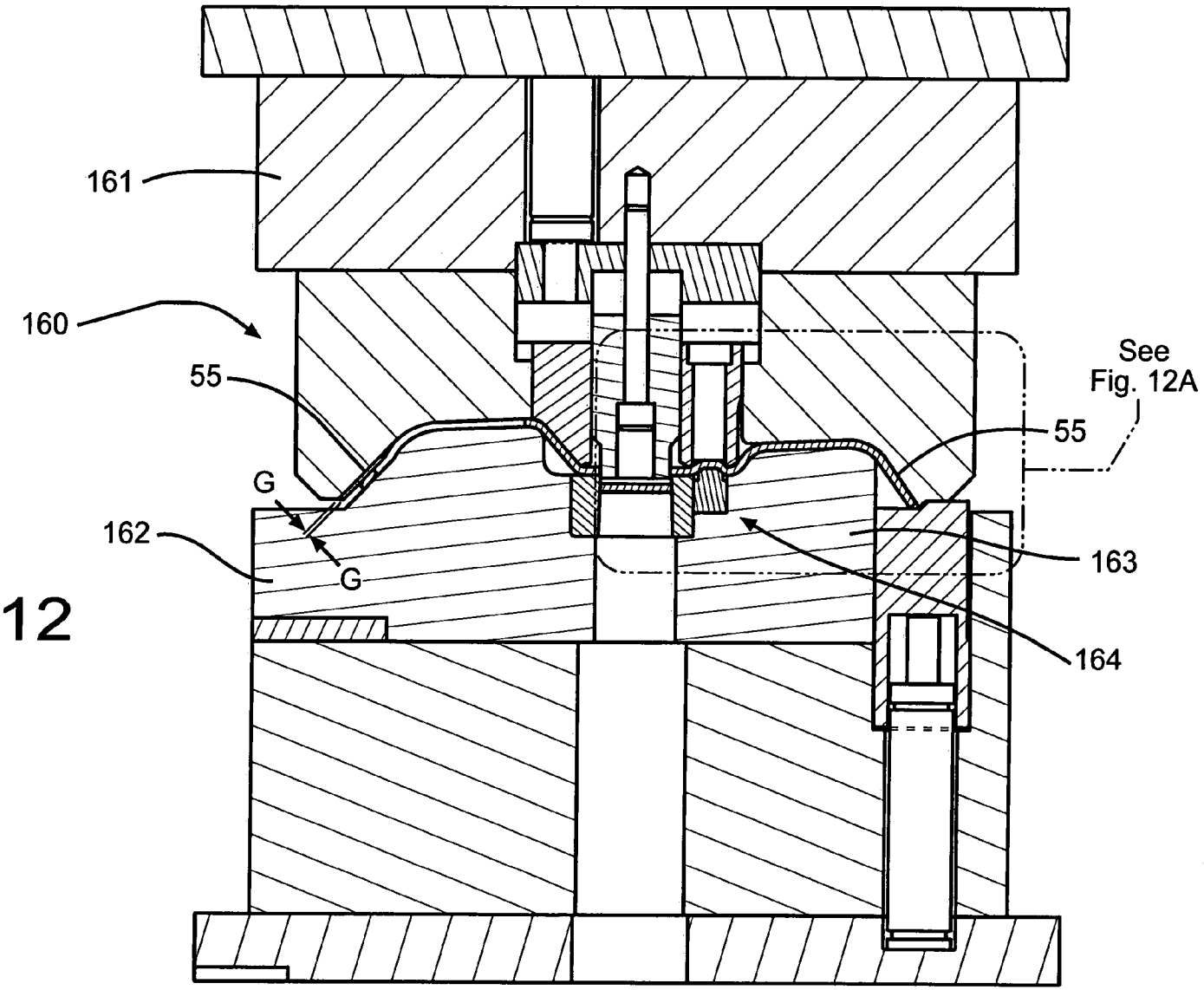
FIGS. 12 and 12A are cross-sectional views of a closed press after processing a wheel disc according to a fifth operation of a second embodiment of the present invention which may replace the fifth operation shown in FIGS. 7 and 7A in connection with the first embodiment of the present invention.
Figure 12A:
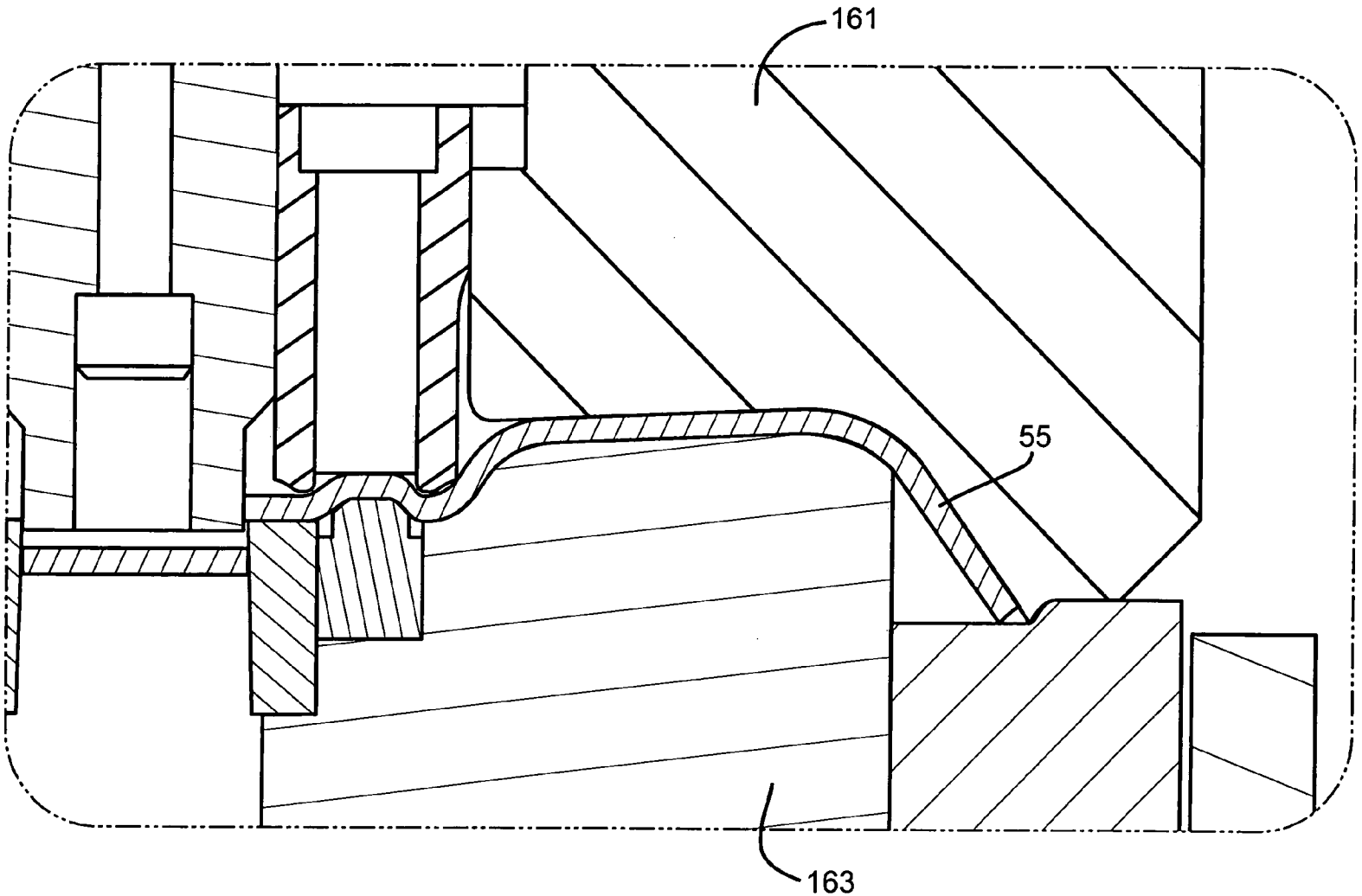

Turning now to FIGS. 11 and 12 and 12A and using like reference numbers to indicate corresponding parts, there is illustrated an alternate partial sequence of operations which can be used to produce the wheel disc of the present invention. Specifically, FIG. 11 may be used in place of the operations shown in connection with FIGS. 6, 6A and 6B above, and FIGS. 12 and 12A may be used in place of the operations shown in connection with FIGS. 7 and 7A above.

As shown in the illustrated embodiment of FIG. 11, a tooling set, indicated generally at 150 is provided. The tooling set 150 includes die details 151 and 152 to preferably simultaneously perform a final shaping of wheel disc 20 to provide areas to receive a central hole and a plurality of lug bolt holes. Also, tooling set 150 includes die details 153 and 154 which perform a coining of the backside of the windows. Thus, as can be seen, the operation in the embodiment illustrated in connection with FIG. 11 does not initially draw down outer band 55 as occurred and described above in connection with the operation in the embodiment shown in connection with FIGS. 6, 6A and 6B.

Figure 12B:
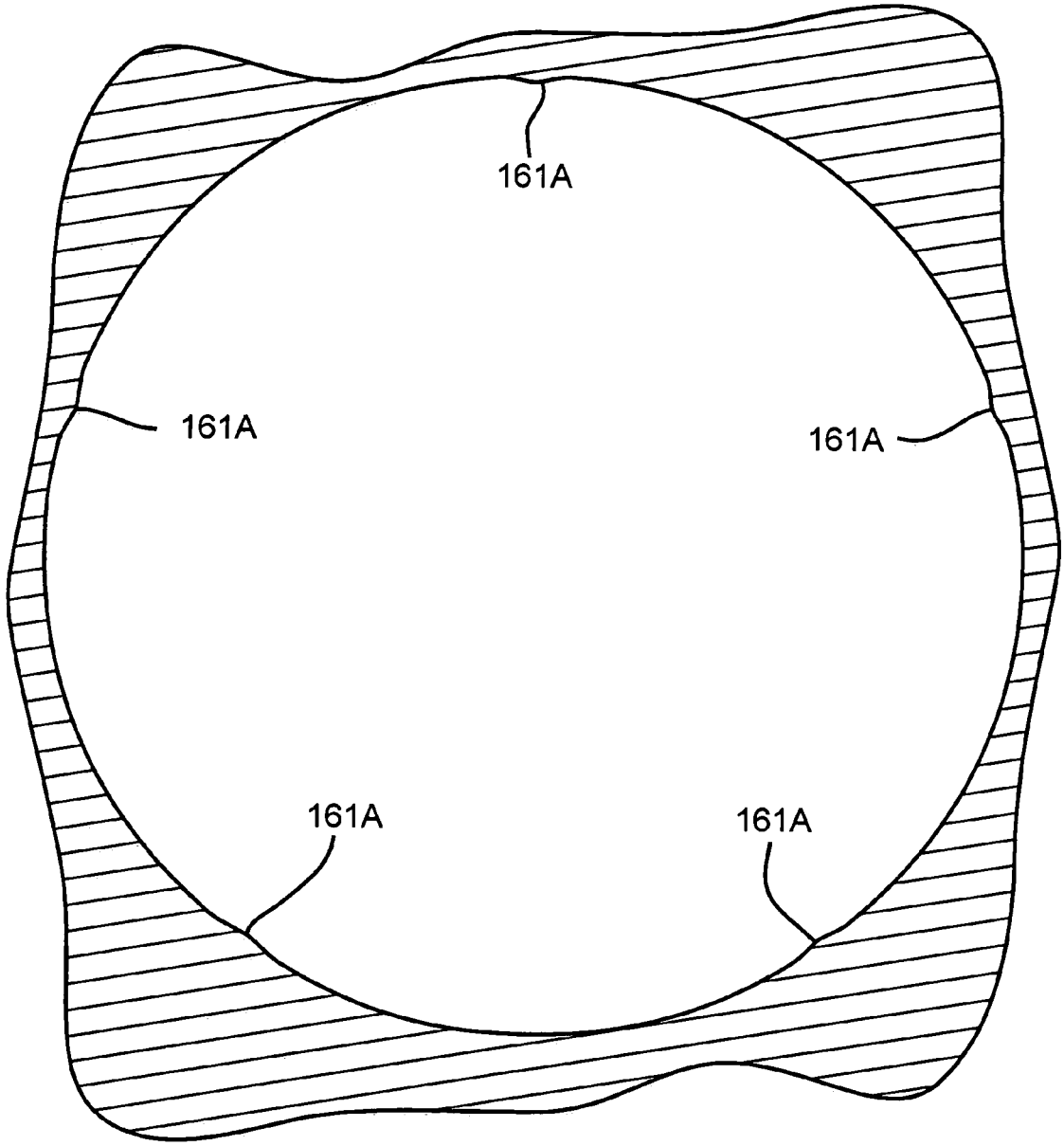
FIG. 12B is a top plan view of a portion of the die set of the fifth operation of the second embodiment of the present invention.

As shown in the illustrated embodiment of FIG. 12, a tooling set, indicated generally at 160 is provided. The tooling set 160 includes an upper ring 161 and a die detail 162 providing an anvil 163. Complementary sloped edges of upper ring 161 and anvil 163 shape outer band 55 into an angled leg. Preferably, the angled leg of outer band 55 is oriented at about twenty degrees from the wheel disc axis X (i.e., the central vertical axis). It is desirable to draw down outer band 55 no more than about twenty degrees to avoid stressing the spoke transitions or causing unwanted undulations. In this embodiment as shown in FIG. 12, the die detail 161 (also schematically shown in FIG. 12A), is designed so that in the areas of the die detail 161 which are adjacent each of the window portions of the wheel disc a slight gap G exists between adjacent surfaces of the die detail 161 and the outer band 55 of the disc when the die detail 161 is in its fully lowered or extended working position. (The gap G shown exaggerated on the left side of FIG. 12 for clarity). Also, in this embodiment, adjacent each the spoke portions of the wheel disc, the die detail 161 is designed with a inwardly curved or arched profile 161A so that when the die detail 161 in its fully lowered position (as shown in FIGS. 12 and 12A), those portions of the outer band 55 which are adjacent each of the spoke portions are forced or deformed more inwardly than those portions of the outer band 55 which are adjacent each of the windows portions. (The inwardly curved profile portions 161A of the die detail 161 shown exaggerated on the FIG. 12B for clarity). In this embodiment, the reason for the die detail 161 having this construction is for the purpose of preventing the outer band 55 from buckling or moving outwardly in the gaps 70 that exist in die detail 66 discussed above and best shown in connection with FIGS. 8 and 8A, due the natural "spring back" inherency of the material during the leg camming operation discussed in connection with these figures. The amount or degree of the inwardly curved profile portions 161A of die detail 161 is determined upon many factors, including but not limited to the particular characteristics of the wheel disc, such as type of material, the material thickness, the size of the wheel disc, and the like, and is generally believed to be about the thickness of the material of the wheel disc; however, the shape and/or amount of the inwardly curved profile portions 161A of die detail 161 can be other than illustrated and described if so desired. In addition, in some wheel disc constructions, die detail 161 may be able to be formed with a continuous or uniform outer profile, i.e., not include the inwardly curved profile portions 161A. Also, as shown in FIG. 12, a die detail 164 is provided for embossing the wheel disc in the area of the lug bolt apertures.

In view of the foregoing description, a stamping or metal forming process has been shown wherein relatively large windows can be formed in a wheel disc. A cylindrical flange for attaching the wheel disc to a rim is obtained without significant undulations in the outer band by virtue of an intermediate camming operation using a cam die with an intermediate ledge.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A method of forming a wheel disc comprising the steps of:

forming a flat disc blank into a generally bowl shaped wheel disc defining a wheel disc axis;

forming the bowl shaped wheel disc to form spoke forming regions adjacent window forming regions;

forming a window in each of the window forming regions in a generally vertical direction, wherein each window has a respective outer edge proximate with a continuous outer band around a periphery of the wheel disc, wherein the windows define a plurality of spokes between adjacent windows, and wherein an angular size of each of the windows along the outer band is preferably greater than an angular size of each of the spokes;

partially closing the outer band toward a cylindrical shape by engaging a cam die radially against at least a portion of the outer band, wherein the cam die comprises a slanted engagement surface having an intermediate horizontal ledge for receiving a peripheral edge of the outer band to reduce undulations of the outer band; and fully closing the outer band substantially into a cylindrical shape by axially wiping the outer band.

2. The method of claim 1 further comprising the step of:

forming the outer band to a position oriented by about forty-five degrees from the wheel axis prior to the partial closing step.

3. The method of claim 2 wherein an axial center region of the wheel disc is formed to a final shape simultaneously with forming the outer band to the forty-five degrees position.

4. The method of claim 2 wherein an axial center region of the wheel disc is formed to a final shape prior to forming the outer band to the forty-five degrees position.

5. The method of claim 1 further comprising the step of:

calibrating a peripheral edge of the outer band by striking the peripheral edge parallel to the wheel axis after the fully closing step.

6. The method of claim 1 further comprising the step of:

forming a center hole and coining a bottom side of the windows prior to the partial closing step.

7. The method of claim 6 further comprising the steps of:

forming the center hole to a calibrated size and location; and forming a plurality of lug bolt holes around a periphery of the center hole.

8. The method of claim 1 wherein the cam die for partially closing the outer band toward a cylindrical shape includes a plurality of inwardly curved profile portions.

9. A method of forming a wheel disc comprising the steps of:

forming a flat disc blank in a first vertical direction into a generally bowl shaped wheel disc defining a wheel disc axis;

forming the bowl shaped wheel disc in a second opposite vertical direction to form spoke forming regions adjacent window forming regions;

forming a window in each of the window forming regions in a generally vertical direction, wherein each window has a respective outer edge proximate with a continuous outer band around a periphery of the wheel disc, wherein the windows define a plurality of spokes between adjacent windows, wherein an angular size of each of the windows along the outer band is preferably greater than an angular size of each of the spokes;

forming the outer band to a position oriented by about forty-five degrees from the wheel disc axis;

partially closing the outer band toward a cylindrical shape by engaging a cam die radially against at least a portion of the outer band, wherein the cam die comprises an engagement surface having an intermediate horizontal ledge for receiving a peripheral edge of the outer band to reduce undulations of the outer band;

fully closing the outer band substantially into a cylindrical shape by axially wiping the outer band; and calibrating the peripheral edge of the outer band by striking the peripheral edge generally parallel to the wheel disc axis.

10. The method of claim 9 wherein an axial center region of the wheel disc is formed to a final shape simultaneously with forming the outer band to the forty-five degrees position.

11. The method of claim 9 wherein an axial center region of the wheel disc is formed to a final shape prior to forming the outer band to the forty-five degrees position.

12. The method of claim 9 further comprising the step of:

forming a center hole and coining a bottom side of the windows prior to the partial closing step.

13. The method of claim 12 further comprising the steps of:

forming the center hole to a calibrated size and location; and forming a plurality of lug bolt holes around a periphery of the center hole.

14. The method of claim 9 wherein forming tools for forming the windows have collars for coining the windows.

15. The method of claim 9 wherein the cam die for partially closing the outer band toward a cylindrical shape includes a plurality of inwardly curved profile portions.

16. A method of forming a wheel assembly comprising the steps of:

forming a flat disc blank into a generally bowl shaped wheel disc defining a wheel disc axis;

forming the bowl shaped wheel disc to form spoke forming regions adjacent window forming regions;

forming a window in each of the window forming regions in a generally vertical direction, wherein each window has a respective outer edge proximate with a continuous outer band around a periphery of the wheel disc, wherein the windows define a plurality of spokes between adjacent windows, and wherein an angular size of each of the windows along the outer band is preferably greater than an angular size of each of the spokes;

partially closing the outer band toward a cylindrical shape by engaging a cam die radially against at least a portion of the outer band, wherein the cam die comprises an engagement surface having an intermediate ledge for receiving a peripheral edge of the outer band to reduce undulations of the outer band; and fully closing the outer band substantially into a cylindrical shape by axially wiping the outer band to produce the wheel disc; and securing the wheel disc to a wheel rim to produce the wheel assembly.

17. The method of claim 16 further comprising the step of:

forming the outer band to a position oriented by about forty-five degrees from the wheel axis prior to the partial closing step.

18. The method of claim 17 wherein an axial center region of the wheel disc is formed to a final shape simultaneously with forming the outer band to the forty-five degrees position.

19. The method of claim 17 wherein an axial center region of the wheel disc is formed to a final shape prior to forming the outer band to the forty-five degrees position.

20. The method of claim 16 further comprising the step of:

calibrating a peripheral edge of the outer band by striking the peripheral edge parallel to the wheel axis after the fully closing step.

21. The method of claim 16 further comprising the step of:

forming a center hole and coining a bottom side of the windows prior to the partial closing step.

22. The method of claim 21 further comprising the steps of:

forming the center hole to a calibrated size and location; and forming a plurality of lug bolt holes around a periphery of the center hole.

23. The method of claim 16 wherein the cam die for partially closing the outer band toward a cylindrical shape includes a plurality of inwardly curved profile portions.

24. A method of forming a wheel assembly comprising the steps of:

forming a flat disc blank in a first vertical direction into a generally bowl shaped wheel disc defining a wheel disc axis;

forming the bowl shaped wheel disc in a second opposite vertical direction to form spoke forming regions adjacent window forming regions;

forming a window in each of the window forming regions in a generally vertical direction, wherein each window has a respective outer edge proximate with a continuous outer band around a periphery of the wheel disc, wherein the windows define a plurality of spokes between adjacent windows, wherein an angular size of each of the windows along the outer band is preferably greater than an angular size of each of the spokes;

forming the outer band to a position oriented by about forty-five degrees from the wheel disc axis;

partially closing the outer band toward a cylindrical shape by engaging a cam die against at least a portion of the outer band, wherein the cam die comprises an engagement surface having an intermediate ledge for receiving a peripheral edge of the outer band to reduce undulations of the outer band;

fully closing the outer band substantially into a cylindrical shape by axially wiping the outer band;

calibrating the peripheral edge of the outer band by striking the peripheral edge generally parallel to the wheel disc axis to produce the wheel disc; and securing the wheel disc to a wheel rim to produce the wheel assembly.

* * * * *

UNITED STATES PATENT AND TRADEMARK OFFICE

CERTIFICATE OF CORRECTION

PATENT NO. : 7,587,825 B2
APPLICATION NO. : 11/344621
DATED : September 15, 2009
INVENTOR(S) : Coleman et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 790 days.

Signed and Sealed this

Twenty-first Day of September, 2010

David J. Kappos

David J. Kappos
*Director of the United States Patent and Trademark Office*